US007762486B2

(12) United States Patent
Mussig et al.

(10) Patent No.: US 7,762,486 B2
(45) Date of Patent: Jul. 27, 2010

(54) SHREDDER

(75) Inventors: William J. Mussig, Seekonk, MA (US); David Logan Baker, Greene, RI (US); Darren W. Abrams, East Greenwich, RI (US); Benoit Devinat, Providence, RI (US); Daniel A. Barry, Berlin, MA (US); TC Wang, Taipei (TW)

(73) Assignee: Staples The Office Superstore, LLC, Framingham, MA (US)

( * ) Notice: Subject to any disclaimer, the term of this patent is extended or adjusted under 35 U.S.C. 154(b) by 0 days.

(21) Appl. No.: 12/011,813

(22) Filed: Jan. 30, 2008

(65) Prior Publication Data

US 2008/0230640 A1 Sep. 25, 2008

Related U.S. Application Data

(60) Provisional application No. 60/898,231, filed on Jan. 30, 2007.

(51) Int. Cl.
*B02C 18/16* (2006.01)

(52) U.S. Cl. ..... 241/100; 241/101.2; 241/236

(58) Field of Classification Search ..... 241/100, 241/236, 101.2

See application file for complete search history.

(56) References Cited

U.S. PATENT DOCUMENTS

| | | | | |
|---|---|---|---|---|
| 929,960 | A | | 8/1909 | Low |
| 2,293,520 | A | * | 8/1942 | Starr ..... 100/285 |
| 2,686,466 | A | | 8/1954 | Lee |
| 3,682,402 | A | | 8/1972 | Goldhammer |
| 3,685,437 | A | | 8/1972 | Panning |
| 3,724,766 | A | | 4/1973 | Bosland |
| 3,754,498 | A | | 8/1973 | Gil |
| 4,637,560 | A | | 1/1987 | Goldhammer |
| 4,650,128 | A | | 3/1987 | Goldhammer |
| 4,700,902 | A | | 10/1987 | Yeomans |
| 4,768,432 | A | | 9/1988 | Storlie |
| 4,821,967 | A | | 4/1989 | Moriyama |
| 4,873,811 | A | | 10/1989 | Izumitani et al. |
| 4,957,243 | A | | 9/1990 | Kanagaki et al. |

(Continued)

FOREIGN PATENT DOCUMENTS

| | | |
|---|---|---|
| CA | 2078617 AA | 3/1994 |

(Continued)

OTHER PUBLICATIONS

EDS-102 shredder, Internet printout, Executive Machines.com, printed Jan. 18, 2006.

(Continued)

*Primary Examiner*—Mark Rosenbaum
(74) *Attorney, Agent, or Firm*—Wolf, Greenfield & Sacks, P.C.

(57) ABSTRACT

A shredder including a shredding mechanism, a housing at least partially enclosing the shredding mechanism, and a receptacle that receives and contains shredded material is provided. The shredder may further includes a compactor including a ram that, when actuated, moves through the receptacle to compress shredded material in the receptacle. The shredder may further include a foot operated lever coupled to the compactor to actuate the ram. The compactor may also include a scissor mechanism that guides the ram through the receptacle.

7 Claims, 23 Drawing Sheets

U.S. PATENT DOCUMENTS

| | | | |
|---|---|---|---|
| 5,035,366 | A | 7/1991 | Hashimoto et al. |
| 5,044,270 | A | 9/1991 | Schwelling |
| 5,067,666 | A | 11/1991 | Sussman |
| 5,156,346 | A | 10/1992 | Portz |
| 5,269,473 | A | 12/1993 | Strohmeyer et al. |
| 5,427,321 | A | 6/1995 | Takahashi et al. |
| 5,429,313 | A | 7/1995 | Schwelling |
| 5,538,193 | A | 7/1996 | Takahashi et al. |
| 5,897,065 | A | 4/1999 | Schwelling |
| D410,246 | S | 5/1999 | Holderfield |
| 6,000,323 | A | 12/1999 | Schlegel |
| 6,079,645 | A | 6/2000 | Henrickson et al. |
| 6,116,528 | A | 9/2000 | Schwelling |
| 6,164,573 | A | 12/2000 | Li-Ming |
| D437,343 | S | 2/2001 | Ho |
| D444,809 | S | 7/2001 | Chang |
| D446,543 | S | 8/2001 | Ho |
| D448,794 | S | 10/2001 | Wei et al. |
| D449,850 | S | 10/2001 | Ho |
| D451,948 | S | 12/2001 | Wu et al. |
| D454,907 | S | 3/2002 | Ho |
| D455,170 | S | 4/2002 | Ho |
| D455,171 | S | 4/2002 | Ho |
| 6,390,398 | B1 | 5/2002 | Wu Huang |
| 6,454,196 | B1 | 9/2002 | Parke |
| 6,682,006 | B2 | 1/2004 | Lee |
| D498,252 | S | 11/2004 | Lo |
| D498,253 | S | 11/2004 | Lo |
| D502,729 | S | 3/2005 | Lo |
| D502,960 | S | 3/2005 | Lo |
| D502,961 | S | 3/2005 | Lo |
| 6,962,301 | B1 | 11/2005 | Chang |
| 6,964,386 | B2 | 11/2005 | Ho |
| D514,160 | S | 1/2006 | Lo |
| 7,083,131 | B2 | 8/2006 | Ting |
| 7,104,481 | B2 | 9/2006 | Schenker |
| D531,659 | S | 11/2006 | Lo |
| D532,443 | S | 11/2006 | Bai |
| D532,444 | S | 11/2006 | Kao et al. |
| D532,445 | S | 11/2006 | Lo |
| 7,150,422 | B2 | 12/2006 | Wang |
| D534,944 | S | 1/2007 | Bai |
| D534,945 | S | 1/2007 | Bai |
| D535,684 | S | 1/2007 | Lo |
| 7,156,330 | B1 | 1/2007 | Lo |
| D537,108 | S | 2/2007 | Sezaki |
| D541,842 | S | 5/2007 | Sezaki |
| D544,905 | S | 6/2007 | Abramson et al. |
| D545,890 | S | 7/2007 | Abramson et al. |
| D546,872 | S | 7/2007 | Kent et al. |
| D547,366 | S | 7/2007 | Kent et al. |
| D548,272 | S | 8/2007 | Joachim et al. |
| D548,273 | S | 8/2007 | Joachim et al. |
| D556,250 | S | 11/2007 | Kent et al. |
| D557,735 | S | 12/2007 | Ho |
| D586,846 | S | 2/2009 | Kent et al. |
| 7,513,448 | B2 | 4/2009 | Ko |
| 2004/0129810 | A1 | 7/2004 | Kasprowicz et al. |
| 2004/0188553 | A1 | 9/2004 | Lo |
| 2005/0072869 | A1 | 4/2005 | Ting |
| 2005/0218250 | A1 | 10/2005 | Matlin et al. |
| 2005/0236503 | A1 | 10/2005 | Matlin et al. |
| 2005/0253004 | A1 | 11/2005 | Hsieh et al. |
| 2005/0274836 | A1 | 12/2005 | Chang |
| 2006/0054724 | A1 | 3/2006 | Matlin et al. |
| 2006/0054725 | A1 | 3/2006 | Matlin |
| 2007/0006987 | A1 | 1/2007 | Brambilla |
| 2007/0034723 | A1 | 2/2007 | Joachim et al. |

FOREIGN PATENT DOCUMENTS

| | | | |
|---|---|---|---|
| CH | 431373 | | 2/1967 |
| DE | 2214786 | | 9/1973 |
| DE | 3706897 | C1 | 3/1987 |
| DE | 3611640 | A1 | 10/1987 |
| DE | 4313764 | A1 | 11/1993 |
| EM | 000465885003 | | 1/2006 |
| EP | 0589281 | B1 | 9/1993 |
| EP | 1741490 | A1 | 1/2007 |
| GB | 1327177 | | 8/1973 |
| GB | 2081404 | | 9/1998 |
| GB | 2065708 | | 5/2002 |
| JP | 4-210249 | | 7/1992 |
| JP | 6469761 | | 9/1994 |
| JP | 8001024 | A2 | 1/1996 |
| JP | 11010017 | | 1/1999 |
| JP | 11156222 | | 6/1999 |
| JP | 2001293390 | A2 | 10/2001 |
| JP | 2001300339 | | 10/2001 |
| JP | 2002263513 | A2 | 9/2002 |
| JP | 2003205254 | A2 | 7/2003 |
| WO | WO 86/06982 | | 12/1986 |
| WO | WO 00/63609 | A | 10/2000 |
| WO | WO 2005/096742 | A2 | 10/2005 |
| WO | WO 2005/097329 | A1 | 10/2005 |
| WO | WO 2005/102676 | A2 | 11/2005 |
| WO | WO 2006/074122 | A | 7/2006 |

OTHER PUBLICATIONS

EPS-1501X shredder, Internet printout, Executive Machines.com, printed Jan. 18, 2006.

GBC 15 sheet strip-cut shredder, Internet printout, Staples.com, printed Feb. 23, 2006.

GBC 22 sheet strip-cut shredder, Internet printout, Staples.com, printed Feb. 23, 2006.

Whitaker 302 SF high security paper shredder, Internet printout, Whitakerbrothers.com, printed Feb. 23, 2006.

Model Cyclone High Volume Industrial Shredder, Internet printer, balboacheckpro.com, printed Feb. 23, 2006.

Fellowes Powershred PS-65C, Internet printout ABCOffice.com, printed Feb. 23, 2006.

Fellowes Powershred PS-60, Internet printout ABCOffice.com, printed Feb. 23, 2006.

Fellowes Powershred P-40, Internet printout ABCOffice.com, printed Feb. 23, 2006.

Fellowes Powershred SB-85C, Internet printout ABCOffice.com, printed Feb. 23, 2006.

GBC Cross Cut Model Guardian-Light Duty Shredder, Internet printout ABCOffice.com , printed Feb. 23, 2006.

Intimus Paper Shredders—Model 155, Internet printout ABCOffice.com, printed Feb. 23, 2006.

GBC Models 950S and 955X—Desk Side Shredders, Internet printout ABCOffice.com, printed Feb. 23, 2006.

Telko SH2715CP Shredder, Internet printout ABCOffice.com, printed Feb. 23, 2006.

Fellowes Powershred DS-1 Shredder, Internet printout ABCOffice.com, printed Jan. 26, 2006.

Fellowes 11 Sheet Cross-Cut Shredder, Internet printout, Staples.com, printed Feb. 23, 2006.

Invitation to Pay Additional Fees and Partial Search Report from corresponding International Application No. PCT/US2008/001221, mailed Jul. 25, 2008.

International Search Report and Written Opinion from corresponding International Application No. PCT/US2008/001221, mailed Oct. 22, 2008.

* cited by examiner

SHREDDER

RELATED APPLICATION

The application claims the benefit of U.S. Provisional application 60/898,231, filed Jan. 30, 2007 and is hereby incorporated by reference in its entirety.

BACKGROUND

1. Field

The present application relates to a shredder for shredding items, such as, but not limited to papers, credit cards, compact discs (CD's), digital video discs (DVD's) and various types of junk mail.

2. Discussion of Related Art

There is an increasing demand for shredding documents such as those that contain any personal or confidential information. Identity theft is a growing problem and people are becoming more concerned with limiting the general availability and access to this type of information to others.

Various types of shredders, commonly referred to as paper shredders, are currently on the market to shred these documents. People routinely shred documents such as financial statements, medical records, credit cards and employee files. Shredding documents is also a common practice in certain legal and government circumstances. Other items, such as credit card applications and junk mail, are also shred rather than just thrown in the trash to further protect against identity theft.

Shredders are often used to render paper documents unreadable by cutting the document into smaller strips or bits of paper. This is typically accomplished by passing the paper through a mesh that lies between a pair of opposed, rotating cutters. An edge of the paper is initially fed into the mesh, which then begins to shred and pull the paper forward. The mesh reduces the document to the smaller bits or strips of paper, or "shredded material", which is typically received and collected in a shredder receptacle.

Shredded material is often of a lesser density than unshredded material. Consequently, the volume of shredded material received in the receptacle of a shredder is typically greater than that of the documents that produced the shredded material. This increase in volume can create a need to dispose of shredded material more frequently than might otherwise be necessary for unshredded material.

Shredders typically include a slot-like paper inlet that receives and directs paper to the mesh that lies between the opposed cutters, where the documents are shredded. To accommodate documents of varying widths, the inlets are typically made as wide as, or wider than the largest document that is to be accepted by the paper shredder. This, in turn, has required the paper shredders to have a width that is greater than the inlet slot.

Conventional shredders often require a user to carefully insert paper with a leading edge oriented squarely to the mesh of the opposed cutters. Otherwise, the paper may be pulled into the mesh diagonally, which can cause a lateral edge of the paper to contact a side of the paper inlet as the paper progresses toward the mesh. This contact may cause the shredder to become jammed, or the paper to be incompletely shredded.

SUMMARY

According to one aspect, a shredder includes a shredding mechanism, a housing at least partially enclosing the shredding mechanism, and a receptacle, to which the housing is removably coupled, that receives and contains shredded material. The shredder further includes a compactor having a ram that, when actuated, moves through the receptacle to compress shredded material in the receptacle, and a foot operated lever coupled to the compactor to actuate the ram.

According to another aspect, a shredder includes a shredding mechanism, a housing at least partially enclosing the shredding mechanism, and a receptacle, to which the housing is removably coupled, that receives and contains shredded material. The shredder further includes a compactor having a ram that, when actuated, moves through the receptacle to compress shredded material in the receptacle and a scissor mechanism that guides the ram through the receptacle.

According to another aspect, a paper shredder includes a shredding mechanism and a paper inlet that directs paper to the shredding mechanism. The paper inlet has at least one side configured to fold a portion of paper that contacts the at least one side.

According to yet another aspect, a paper shredder includes a shredding mechanism that reduces paper to shredded material. A curved paper inlet of the shredder directs paper to the shredding mechanism and a receptacle receives shredded material from the shredding mechanism. The paper inlet has a pair of opposed sides. Each of the pair of opposed sides comprises a curved surface that, when contacted by an edge of paper that is progressing through the inlet, guides the edge along the curved surface to fold a portion of the paper.

According to another aspect, a method of shredding paper is disclosed that includes feeding one or more sheets of paper, corner first, to a paper inlet of a paper shredder. The lateral edge of the one or more sheets of paper is contacted with a side of the paper inlet. The lateral edge is automatically folded toward a central portion of the inlet with the side of the paper inlet as the one or more sheets of paper progress toward a shredding mechanism of the paper shredder.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. In the drawings, each identical or nearly identical component that is illustrated in various figures is represented by a like descriptor. For purposes of clarity, not every component may be labeled in every drawing.

Various embodiments of the invention will now be described, by way of example, with reference to the accompanying drawings, in which.

DETAILED DESCRIPTION

Figure 1:
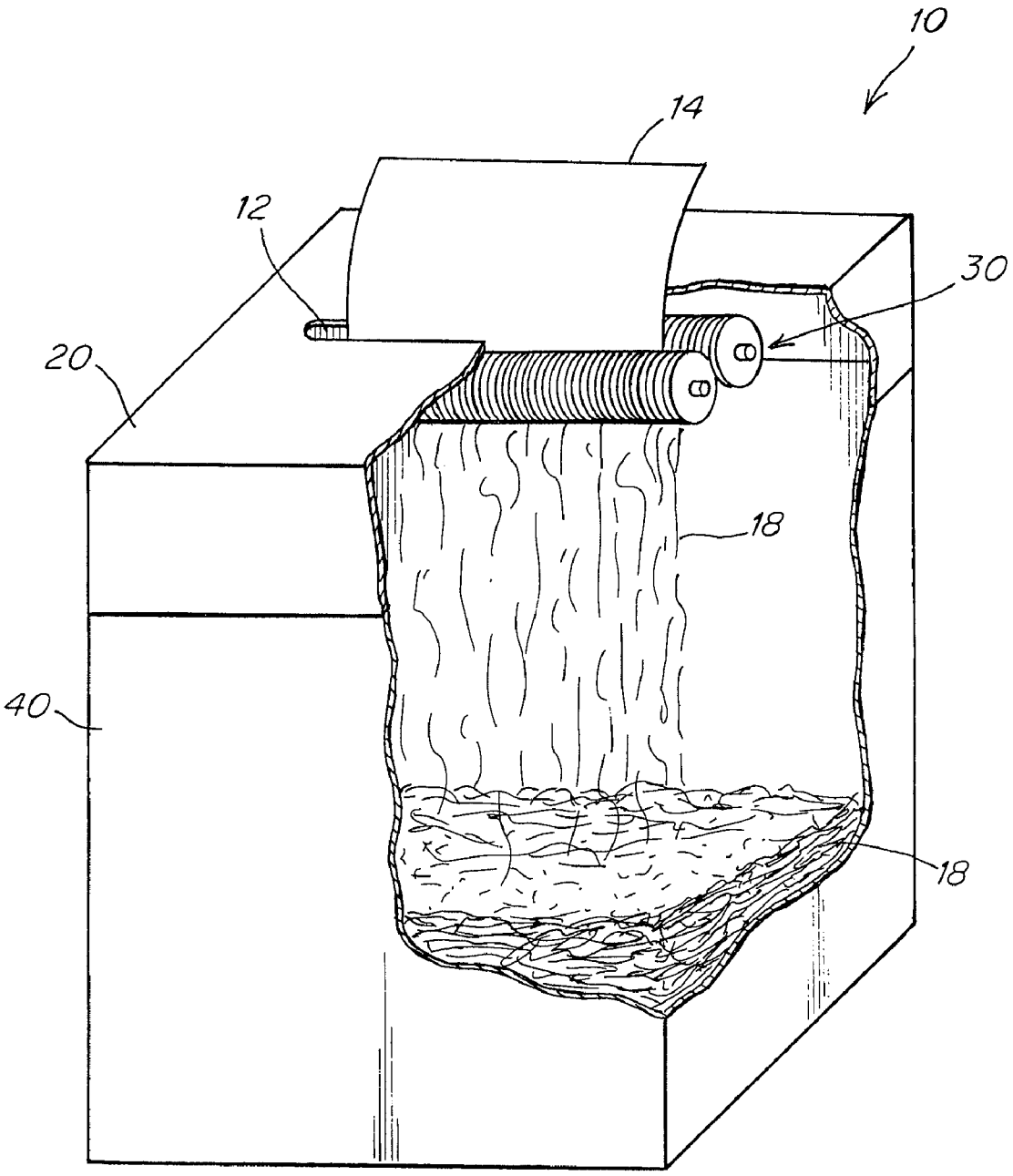
FIG. 1 is a cutaway, perspective view of a paper shredder, as may be found in the related art.

Aspects of the present invention are directed to a shredder used to shred documents or other items which may contain confidential or personal information. The shredder includes a shredding mechanism which may be configured to destroy information in several types of media, for example, but not limited to, paper, CD's, DVD's and/or credit cards.

Certain embodiments of the present invention are directed to a shredder that includes a compactor to compress the shredded material. The compactor may reduce the frequency in which a paper shredder should be emptied.

Other embodiments of the present invention are directed to a shredder that occupies less space, while still being capable of shredding documents of a size commonly found in an office. Further embodiments of the present invention are directed to shredders that are less prone to jamming.

Turning now to the drawings, it should be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one figure, and/or may also encompass embodiments combining components illustrated in multiple different drawings.

In FIG. 1, a shredder 10 is illustrated. The shredder 10 includes a shredding mechanism 30 which is at least partially enclosed within a housing 20. In some embodiments, such as the embodiment illustrated in FIG. 1, the shredding mechanism 30 is completely enclosed within the housing 20. The shredding mechanism 30 may include a plurality of rotating blades or cutters configured to shred an item, such as a document. However, it should be appreciated that the present invention is not limited to a particular type of shredding mechanism configuration.

A receptacle 40 is positioned adjacent the housing 20 to contain material shredded by the shredder mechanism 30. As shown, the housing 20 and shredding mechanism 30 may be positioned on top of the receptacle 40.

The housing 20 includes at least one inlet 12 for inserting items, such as paper 14, to be shred into the shredding mechanism 30. In one embodiment, the housing 20 may include a plurality of inlets 12 configured to receive various types of items to be shred, including, but not limited to paper documents, envelopes, discs, credit cards, etc.

Items to be shred are fed into opening 12. This may automatically trigger the shredding mechanism 30 to start which pulls the item into the shredder 10. As described in greater detail below, the housing 20 may include another opening or outlet 60 (see FIG. 15) on a side or bottom of the housing adjacent the shredding mechanism 30. In the embodiment illustrated in FIG. 15, the outlet 60 is located on the underside of the housing 20. As the blades of the shredding mechanism 30 rotate to cut the item, the shredded material 18 fall through the outlet 60 and into the receptacle 40 and builds up within the receptacle 40.

Periodically, the accumulated shredded material 18 in the receptacle 40 must be discarded. This may be accomplished by separating the receptacle 40 from the housing 20. Once separated, the shredded material 18 may be discarded, and thereafter the receptacle 40 may be recoupled to the housing 20.

As mentioned above, the shredded material is often of a lesser density than unshredded material, so the volume of the shredded material 18 received in the receptacle 40 of a shredder 10 is typically greater than that of the documents that produced the shredded material 18. Applicants recognized that the shredded material 18 may quickly build up within the receptacle 40, causing the receptacle 40 to need to be emptied frequently.

Therefore, aspects of the invention are directed to a shredder having features to compact the shredded material 18 that is received by the receptacle 40. Compacting the shredded material 18 presses the material 18 into a more dense configuration which may allow a user to shred more items before needing to stop to empty the receptacle 40.

Figure 2:
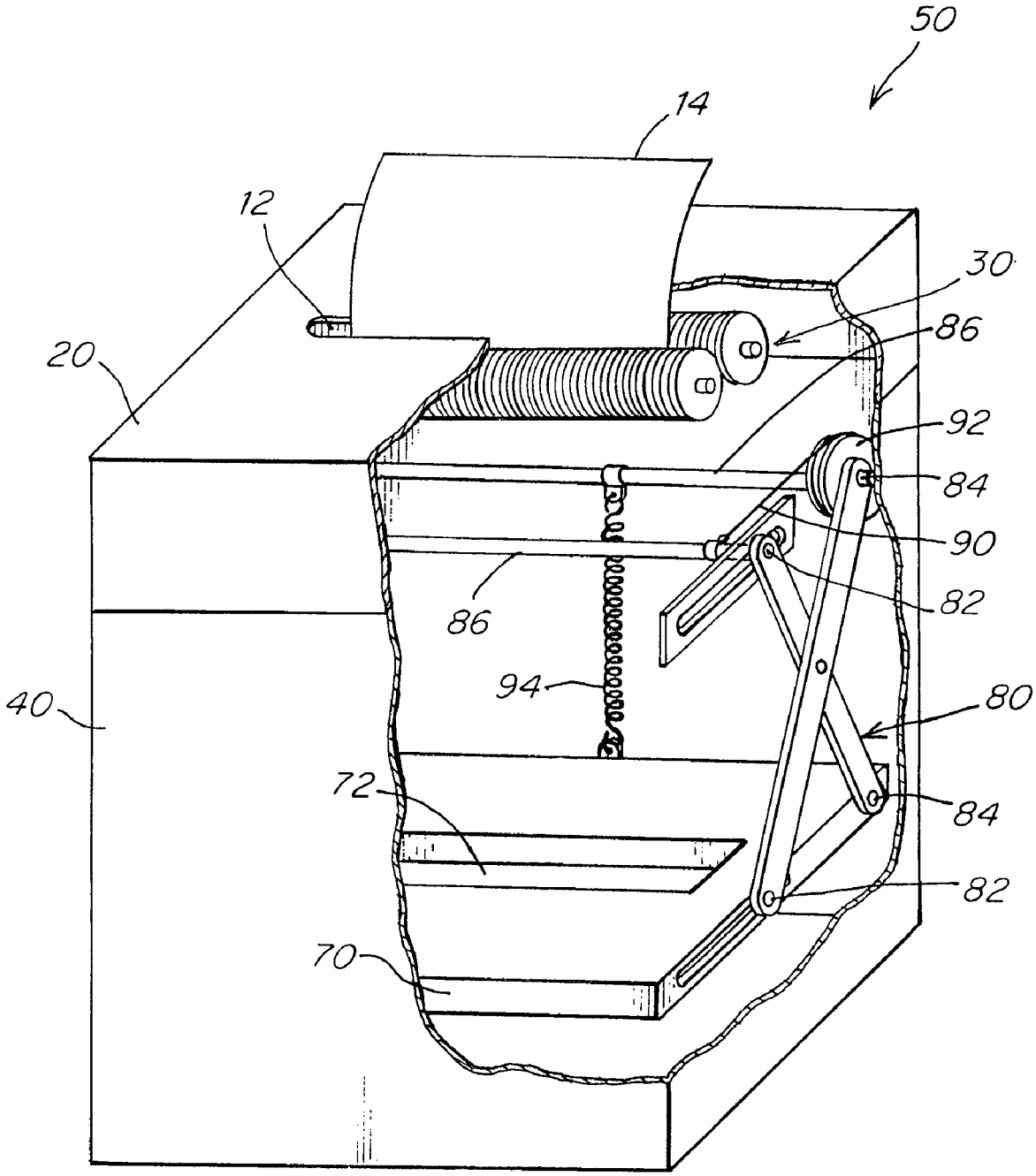
FIG. 2 is a cutaway, perspective view of an embodiment of a shredder that includes a compactor for compressing shredded material in the receptacle.

One embodiment of a compacting shredder 50 is shown in FIG. 2. As illustrated, the compactor comprises a ram 70 that, when actuated, moves within the receptacle 40 to compress the shredded material 18 against an opposing surface. In this particular illustrative embodiment, the ram 70 comprises a plate-like structure. In FIG. 2, the ram 70 is shown in a fully actuated state such that the ram 70 is adjacent the bottom inner surface of the receptacle 40. Prior to actuation, the ram 70 may be positioned adjacent to the outlet 60 (see FIG. 15) and the shredder mechanism 30 above the receptacle 40. As shown in the illustrative embodiment, the ram 70 may include an opening 72 that corresponds in size and shape to the shredder mechanism 30 to allow shredded material 18 from the shredder mechanism 30 to fall through the opening 72 and toward the bottom of the receptacle 40. As shown, the ram 70 is mounted to a scissor-like mechanism 80 that guides the ram 70 downward to press the accumulated shredded material 18 toward the bottom of the receptacle 40. After actuation, a resilient member, such as spring 94 may urge the ram 70 back upward, adjacent to the shredder mechanism 30 to a non-actuated position.

As shown in FIG. 2, the ram 70 may be mounted on each of two opposed sides to a scissor-like mechanism 80 that expands to guide the ram 70 through the receptacle 40 to compress the shredded material 18. In one embodiment, each scissor-like mechanism 80 comprises four connection points: one pivoting connection 84 to each of the receptacle 40 and the ram 70, and one slidable connection 82 to each of the receptacle 40 and the ram 70. The slidable connections 82 to each of the receptacle and the ram 40 or movable surface may be made via bars 86 that extend across the length of the receptacle 40. These bars 86 may move laterally within the receptacle 40 as the mechanism 80 is actuated and the ram 70 traverses downwardly.

The scissor-like mechanism 80 may be actuated in a various of ways, as the present invention is not limited in this respect. As shown in the illustrative embodiment of FIG. 2, a cable 90 may be attached at one end to the bar 86 that spans between the slidable connections 82 of the mechanism, and at the other end to a camming wheel 92. When the camming wheel 92 is rotated, the cable 90 pulls the slidable connections 82 laterally, which operates the scissor-like mechanism 80 to move the ram 70 downwardly to compress shredded material 18.

Figure 3A:
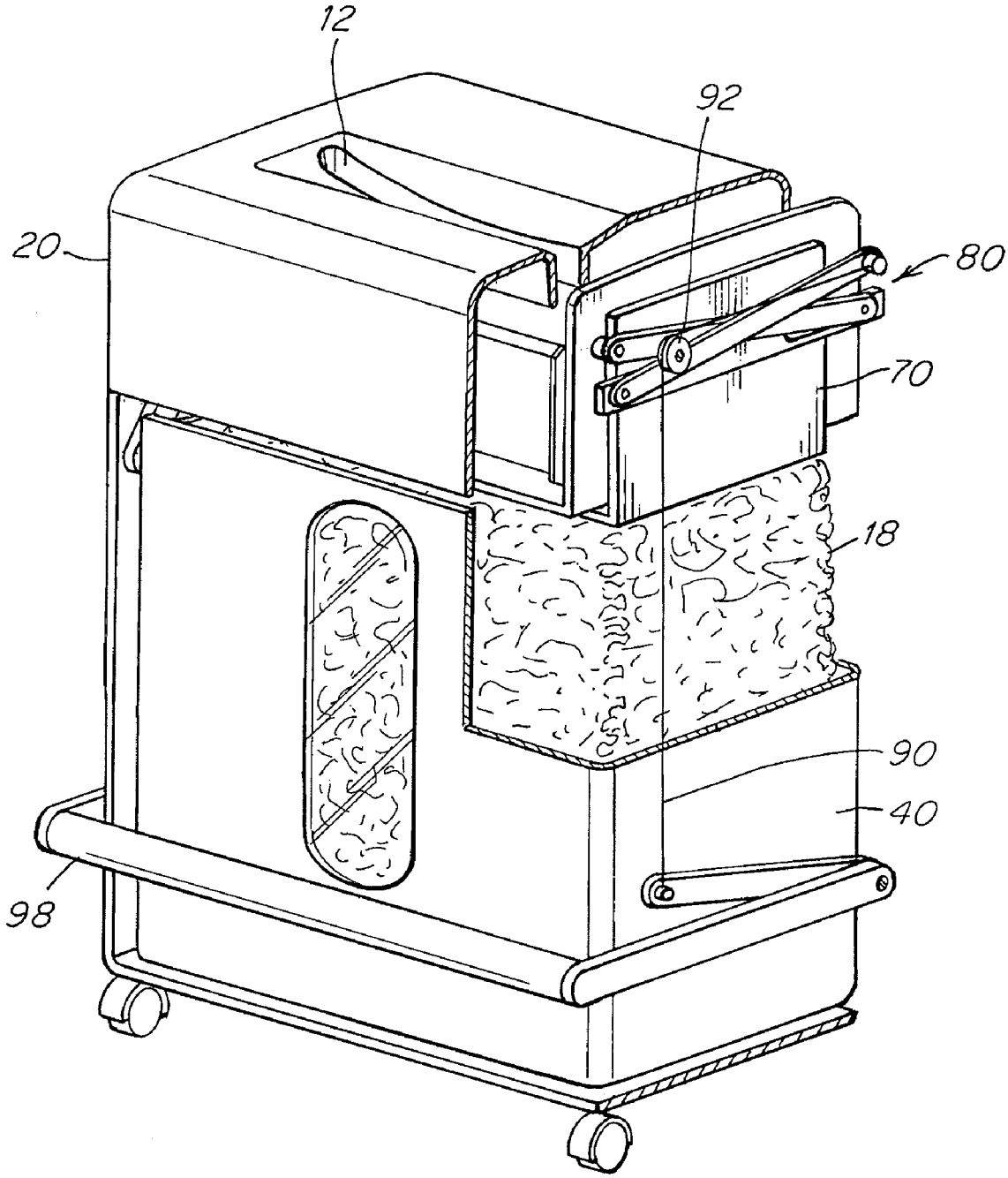
FIGS. 3*a*-3*b* illustrate shredded material being compressed by a compacting shredder according to one embodiment.
Figure 3B:
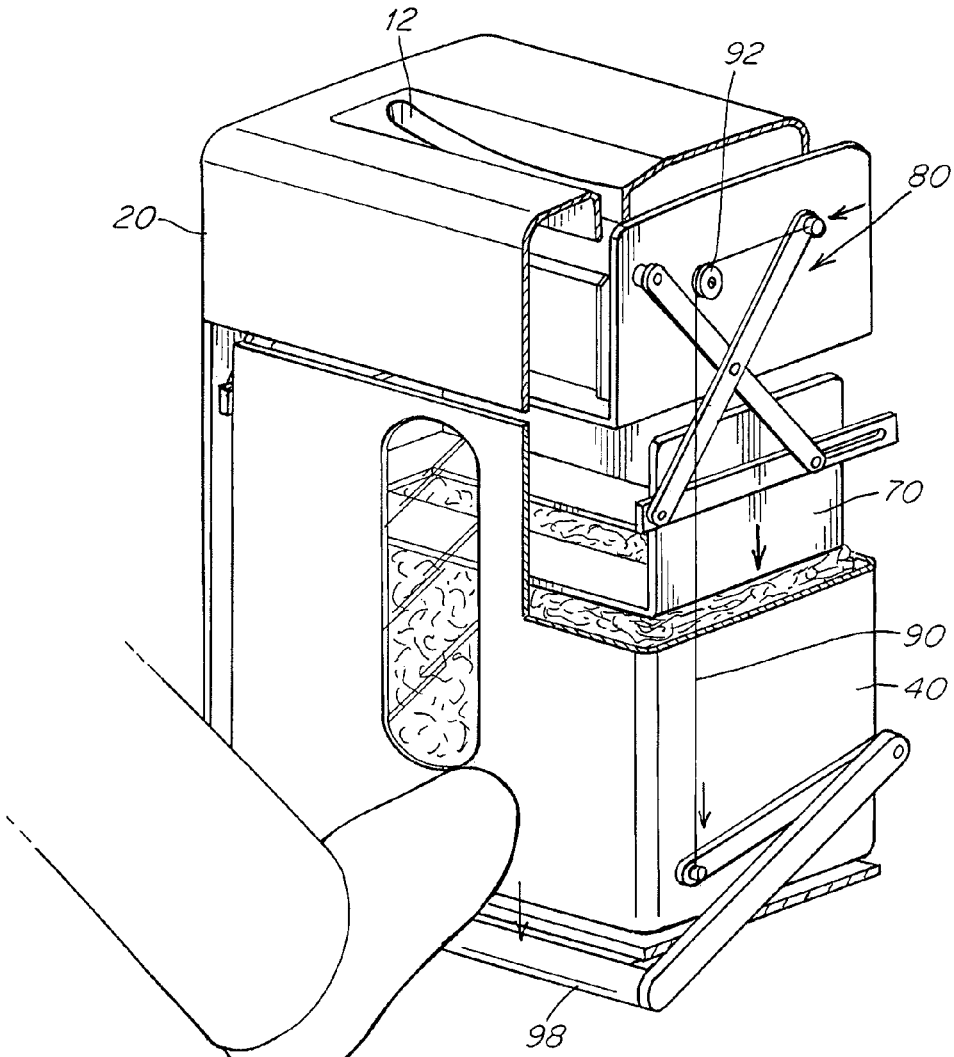
Figure 4:
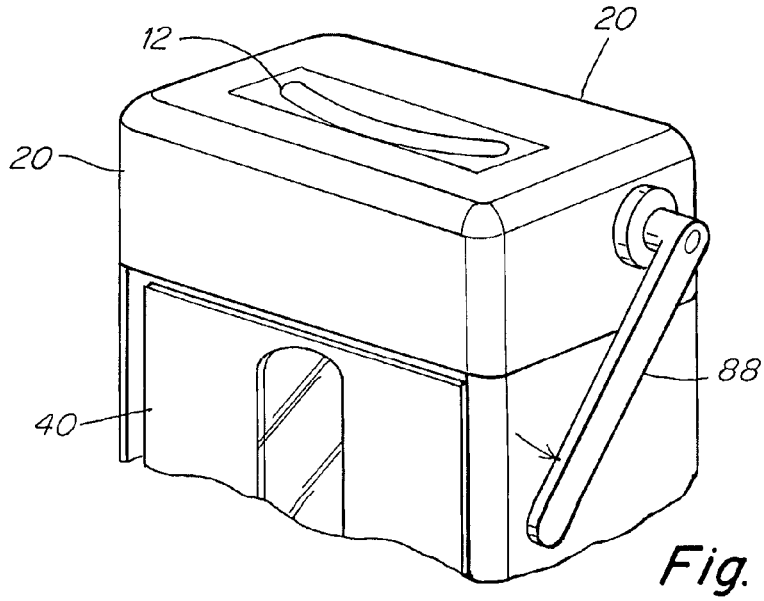
FIG. 4 illustrates another embodiment of compacting shredder.

As shown in FIGS. 3*a*-3*b*, the ram 70 may be actuated by depressing a foot lever 98 on the side of the receptacle 40 that, through a cable mechanism 90, rotates the camming wheel 92. As discussed above, rotation of the camming wheel 92 causes the scissor-like mechanism 80 to urge the ram 70 downwardly to compress shredded material 18. Alternately, the scissor-like mechanism 80 may be actuated by a handle 88 mounted directly to the camming wheel 92, as shown in the embodiment of FIG. 4. Rotation of the handle 88 may cause direct rotation of the camming wheel 92 which, in turn, actuates the compacting ram 70. According to some embodiments, a shredder 10 may be configured to optionally receive a handle 88 or a foot lever 98, depending on the user's preference.

Figure 5A:
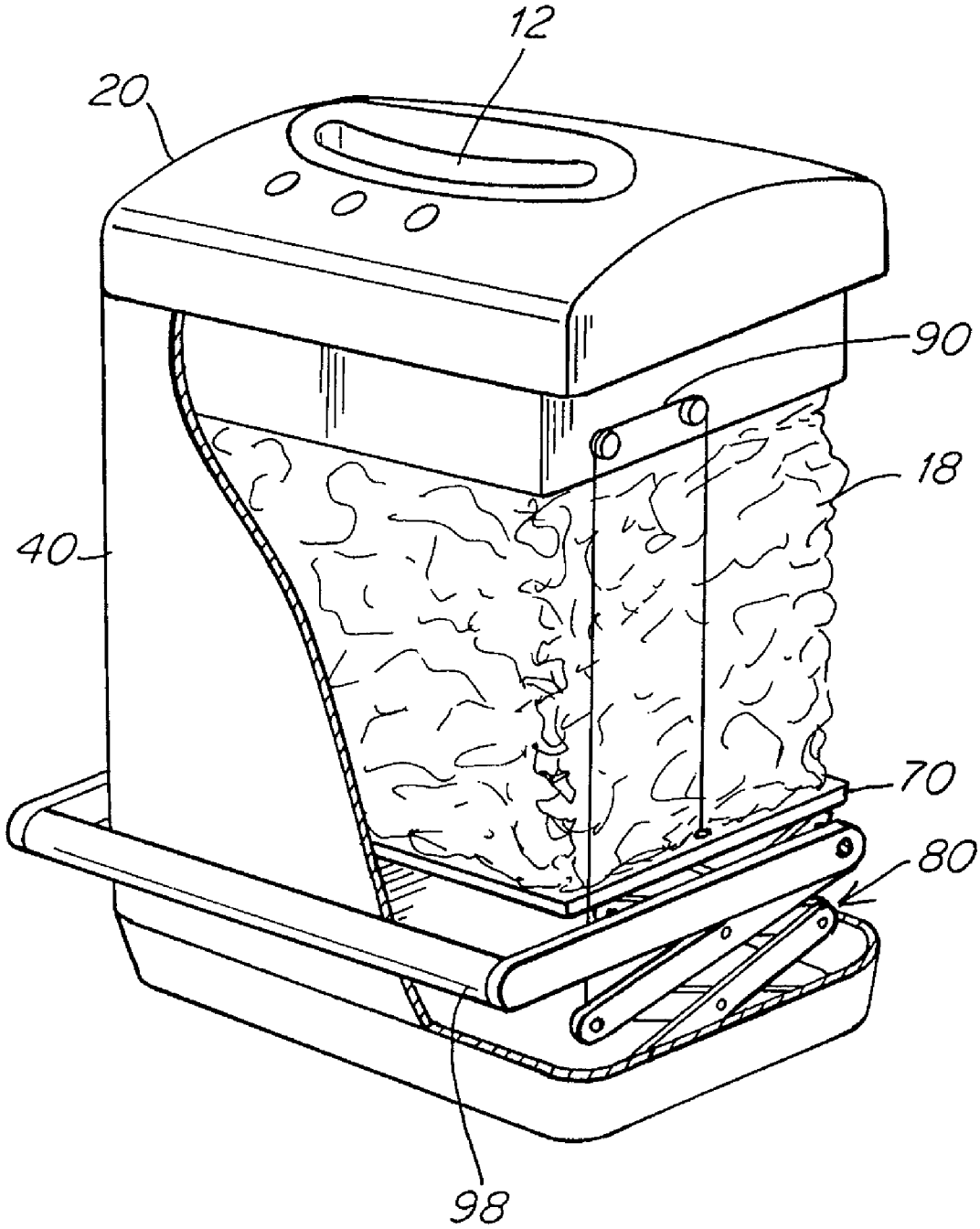
FIGS. 5*a*-5*b* illustrate a compacting shredder according to another embodiment of the present invention.
Figure 5B:
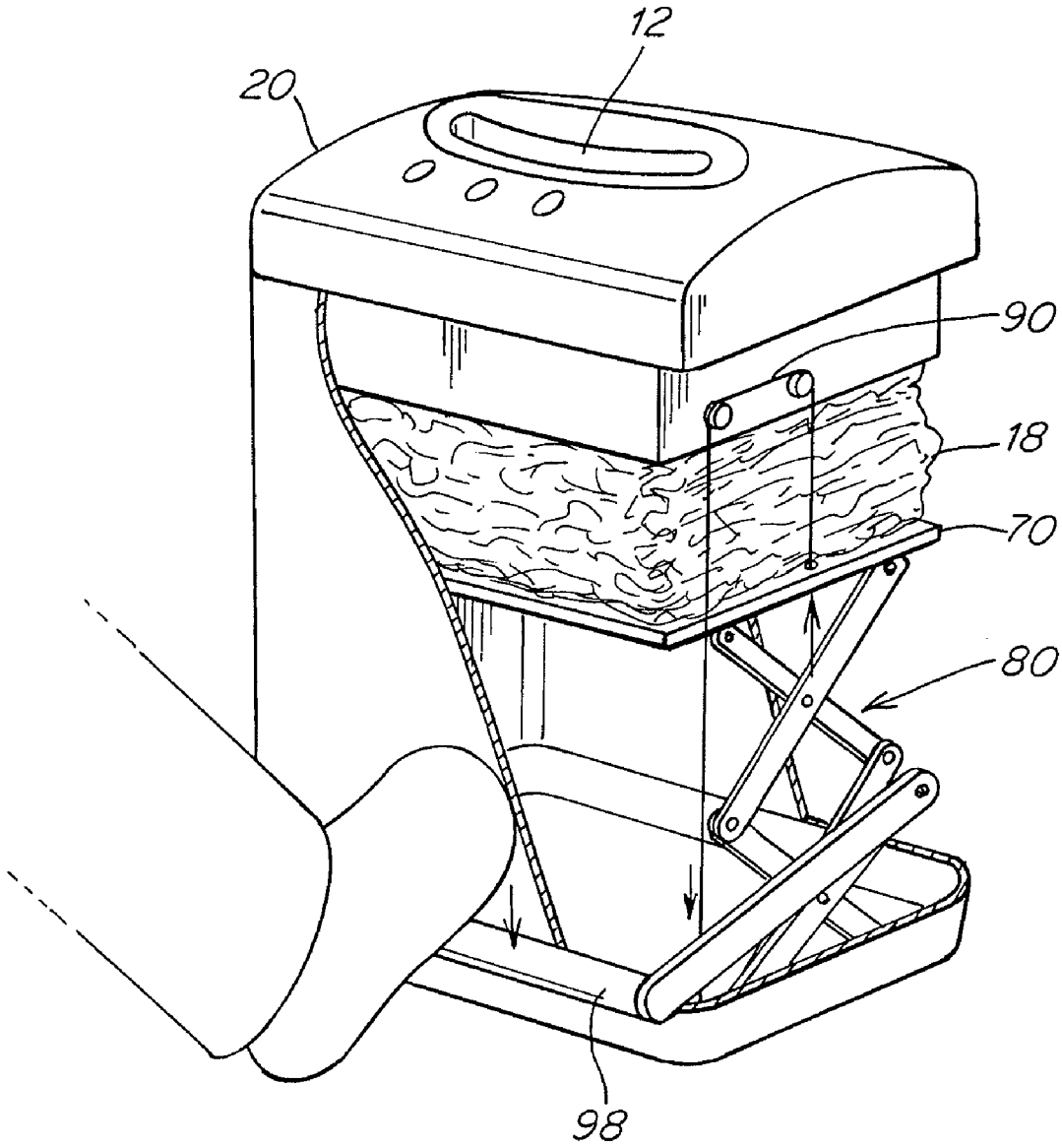

According to some embodiments, the ram 70 may move in directions other than downward to compress shredded material 18, as the invention is not so limited. By way of example, the embodiment represented by FIGS. 5*a*-5*b* includes a scissor-like mechanism 80 that, when actuated by a foot lever 98, causes a ram 70 to move upward to compress shredded material 18 against an upper surface of the receptacle 40.

Figure 6:
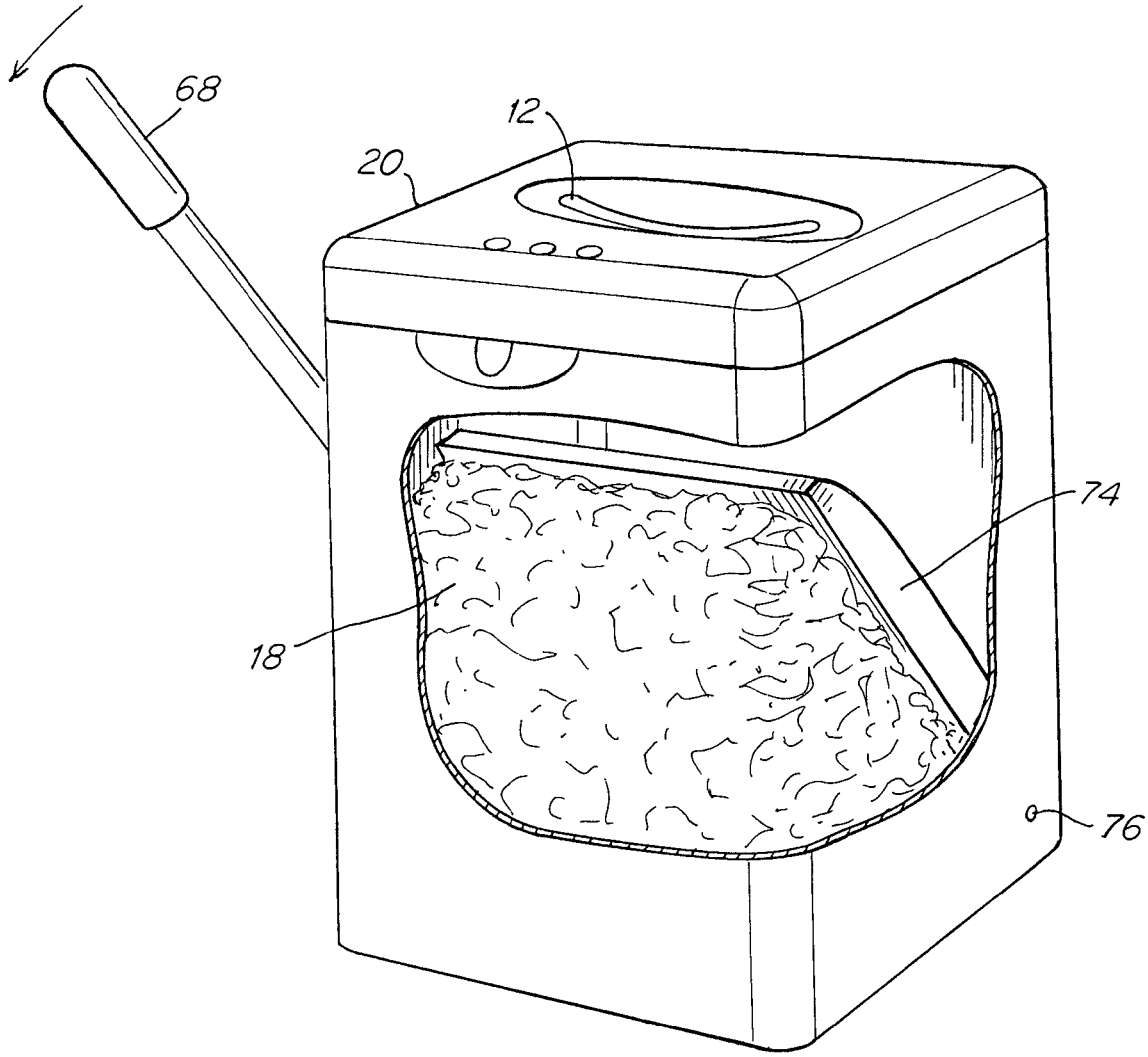
FIG. 6 illustrates a compacting shredder with a ram that pivots about a fixed axis to compress shredded material.

It is to be appreciated that mechanisms, other than the scissor-like mechanism 80 described above, may be used to move a ram 70 to compress the shredded material 18. In the illustrative embodiment of FIG. 6, a ram 74 rotates about a fixed axis 76 in the receptacle 40 to compress the shredded material 18 against a lower wall of the receptacle 40. The movable surface of the ram 74 may be connected directly to a handle 68 that also rotates about the fixed axis 76 to actuate the compactor. A torsional spring (not shown) may be positioned about the axis to urge the ram 74 in the upward position when not in use.

Figure 7A:
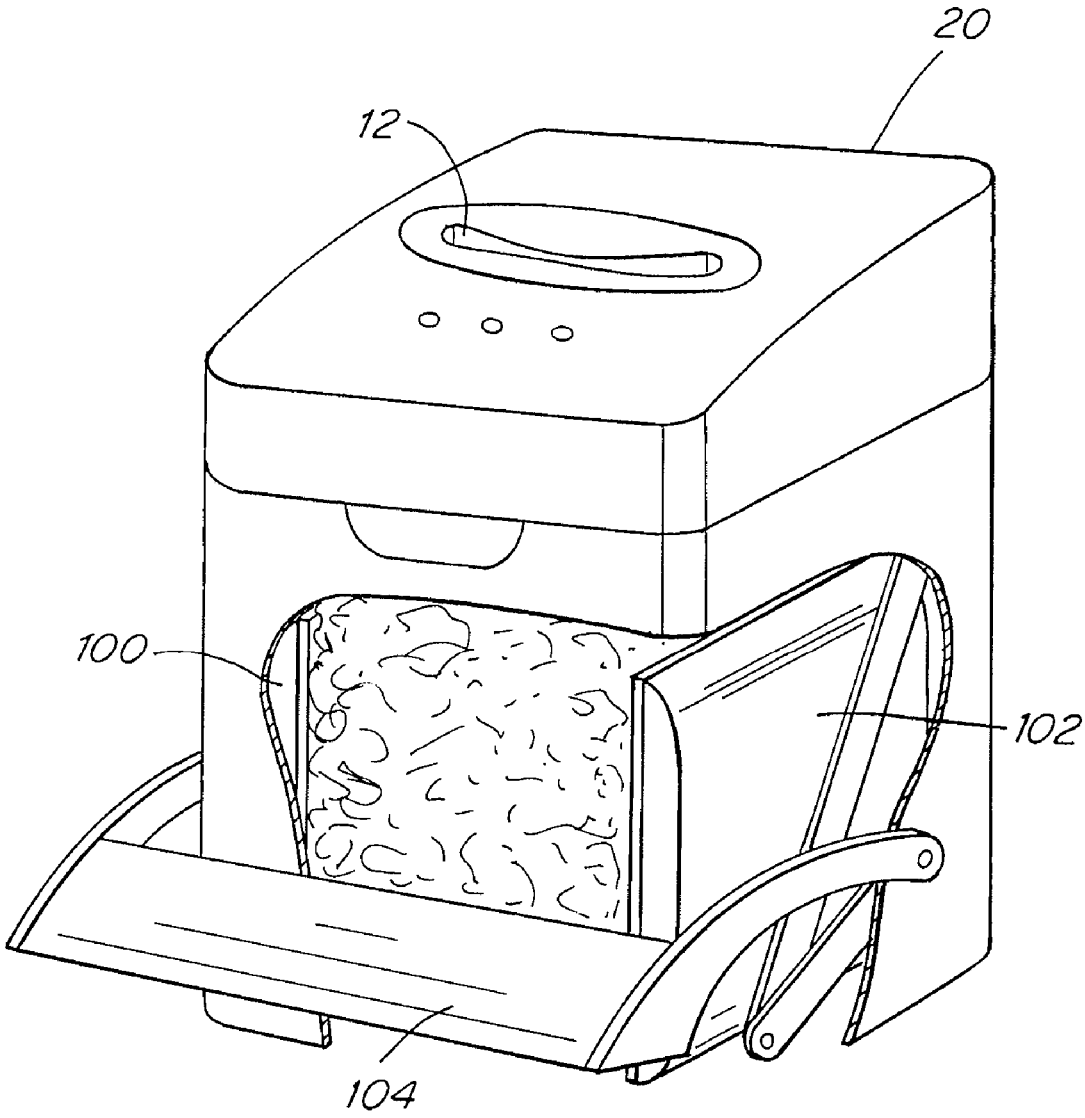
FIGS. 7*a*-7*b* illustrate a compacting shredder with a ram that includes opposed, movable surfaces that compress shredded material.
Figure 7B:
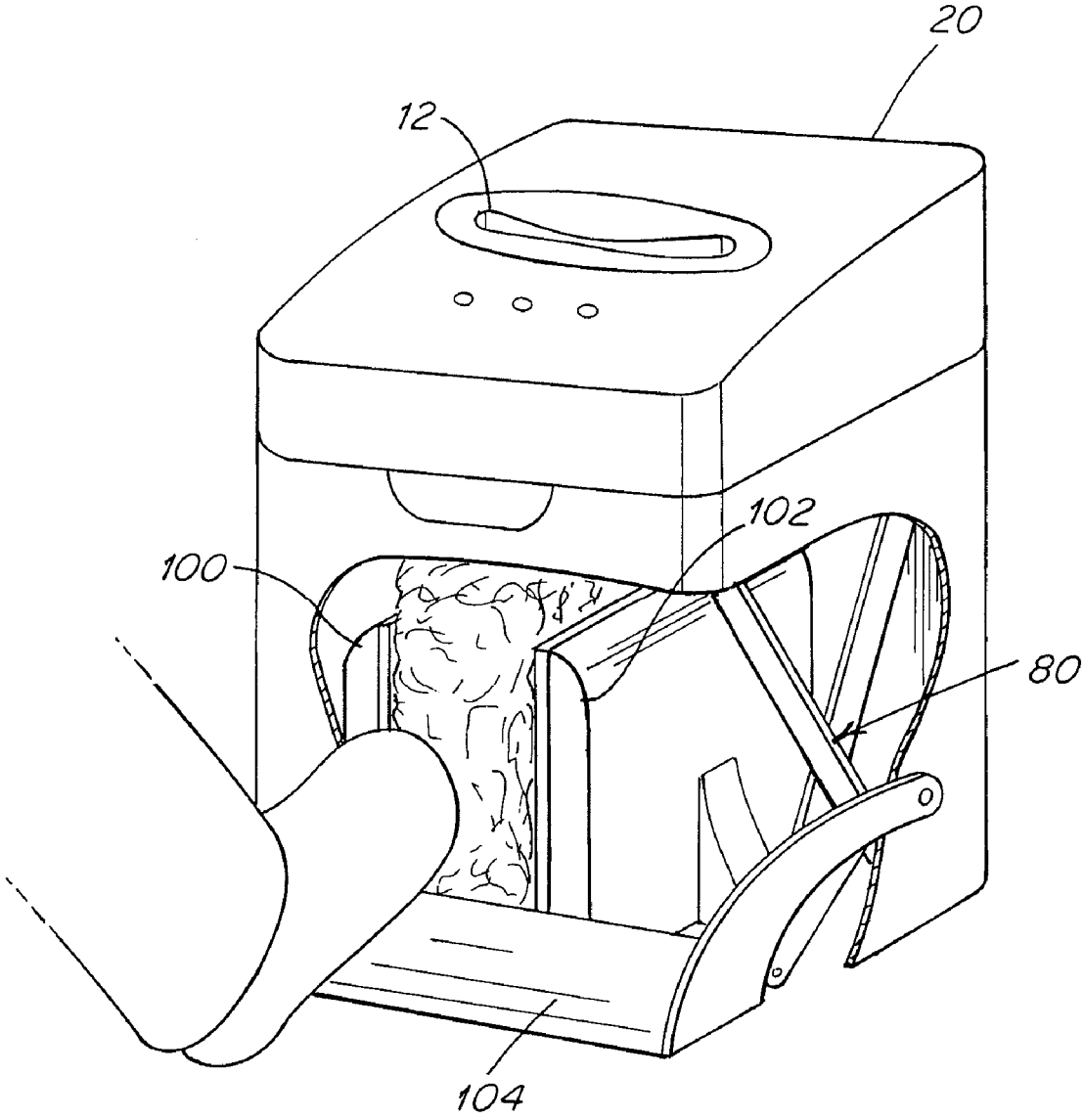

As shown in the embodiment of FIGS. 7*a*-7*b*, multiple movable surfaces may be used to compress shredded material. For example, in the embodiment illustrated in FIGS. 7*a*-7*b*, a pair of opposed movable surfaces 100, 102 move laterally, toward one another, to compress shredded material 18 therebetween. The pair of movable surfaces 100, 102 may be actuated through a mechanism when a foot lever 104 is depressed, much like the embodiment of FIGS. 3*a*-3*b*, although other mechanisms are possible.

Figure 8A:
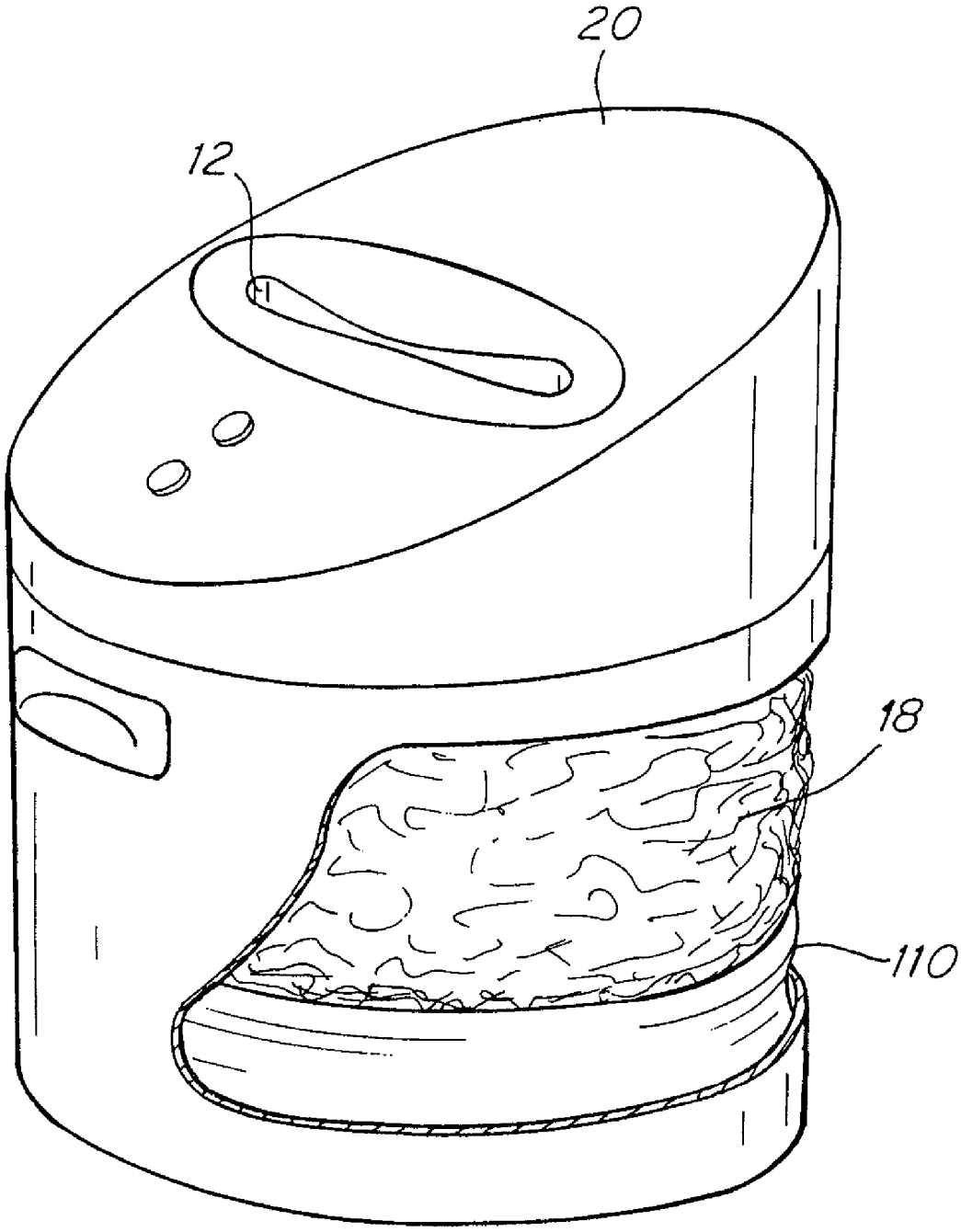
FIGS. 8*a*-8*b* illustrate a compacting shredder with an fluid actuated bladder that compresses shredded material.
Figure 8B:
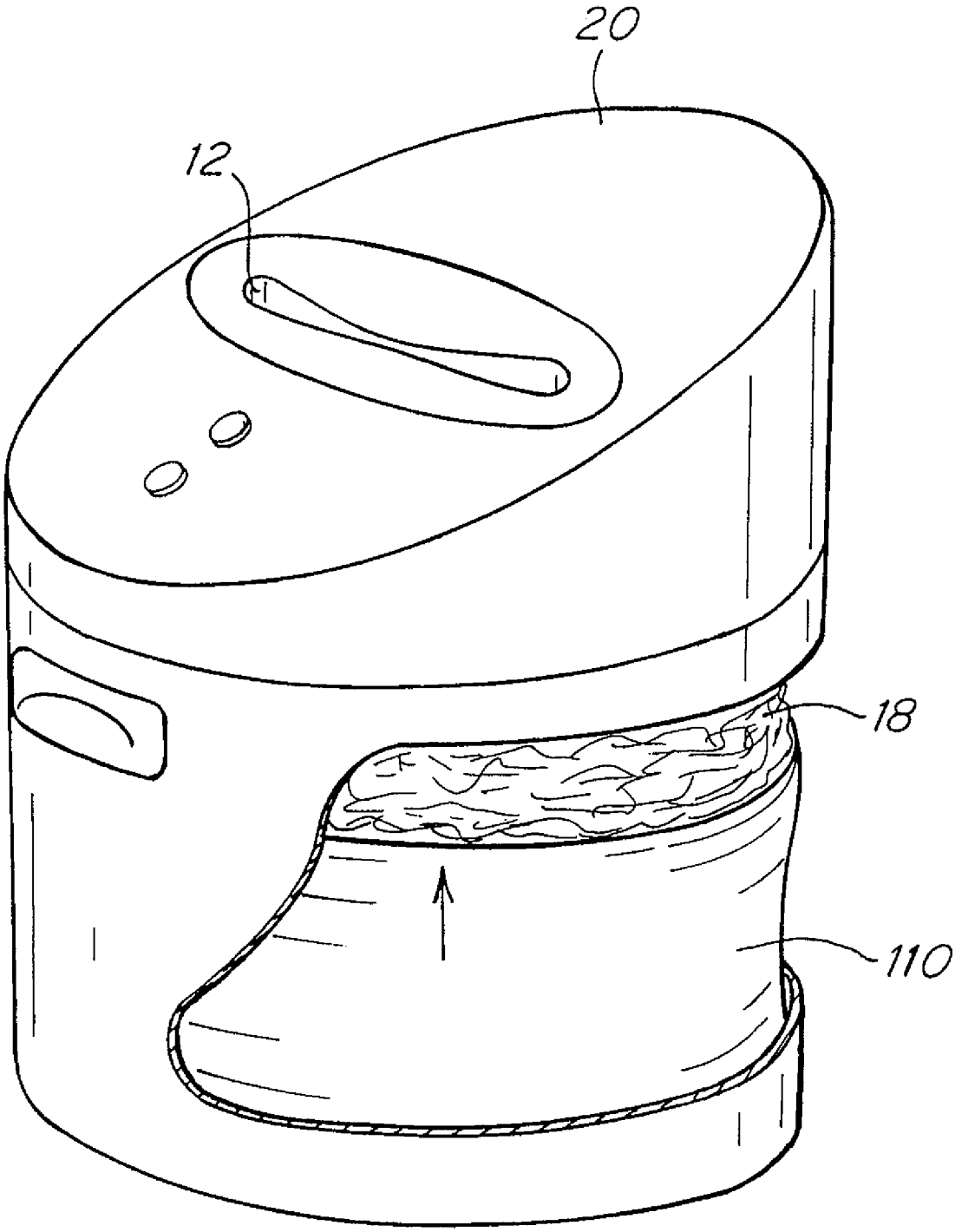

Embodiments of the present invention may compress shredded material 18 with one or more rams with movable surfaces, other than plate-like ram structures. By way of example, the embodiment of FIGS. 8*a*-8*b* includes a bladder 110 that conforms to the inner surface of the receptacle 40 when inflated. Either at a predetermined interval, or when activated by a user, the shredder fills the bladder 110 with compressed air. When inflated, the bladder 110 compresses shredded material 18 in the receptacle 40 against the receptacle walls.

Embodiments of the compacting shredder may be actuated manually or automatically, as the invention is not so limited. As shown in FIGS. 2-7, shredders may include hand or foot levers to manually actuate the ram 70, 74 of a compactor. Alternately, a motor may be incorporated into these embodiments, or others, to move a ram 70, 74 automatically in a predetermined manner. For instance, the ram 70, 74 may move automatically after the shredder has been turned on and in operation for a predetermined amount of time, or sensors may be employed so that the ram 70, 74 may move automatically after a particular height of the shredded material 18 has accumulated in the receptacle 40. Various embodiments may also have an electronic switch that, when actuated, causes a motor to actuate the ram 70, 74 of a compactor. Still, other approaches for actuating compactors are possible, as aspects of the invention are not limited in this respect.

Figure 9:
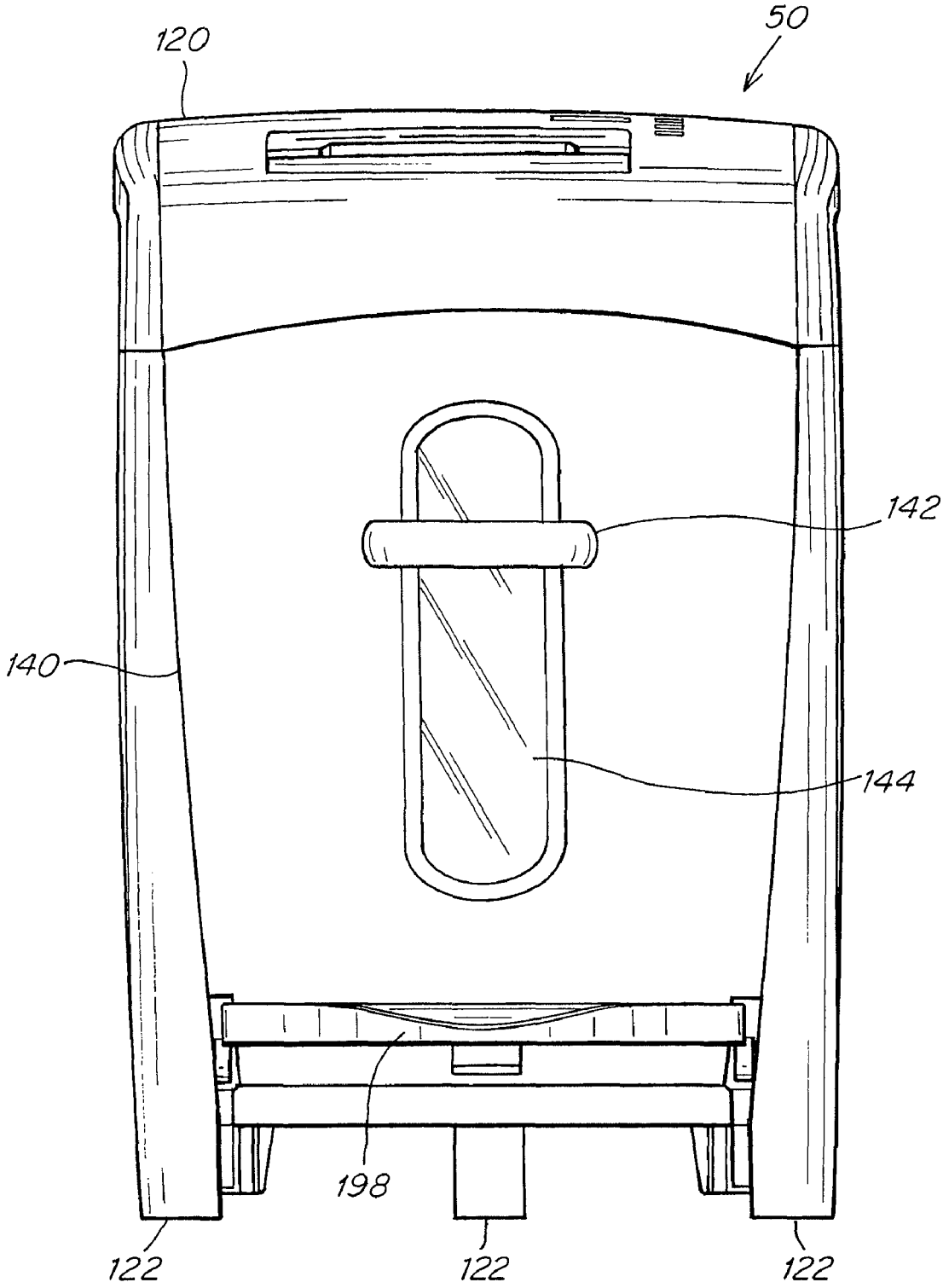
FIG. 9 illustrates a front view of a compacting shredder according to another embodiment of the present invention.
Figure 10:
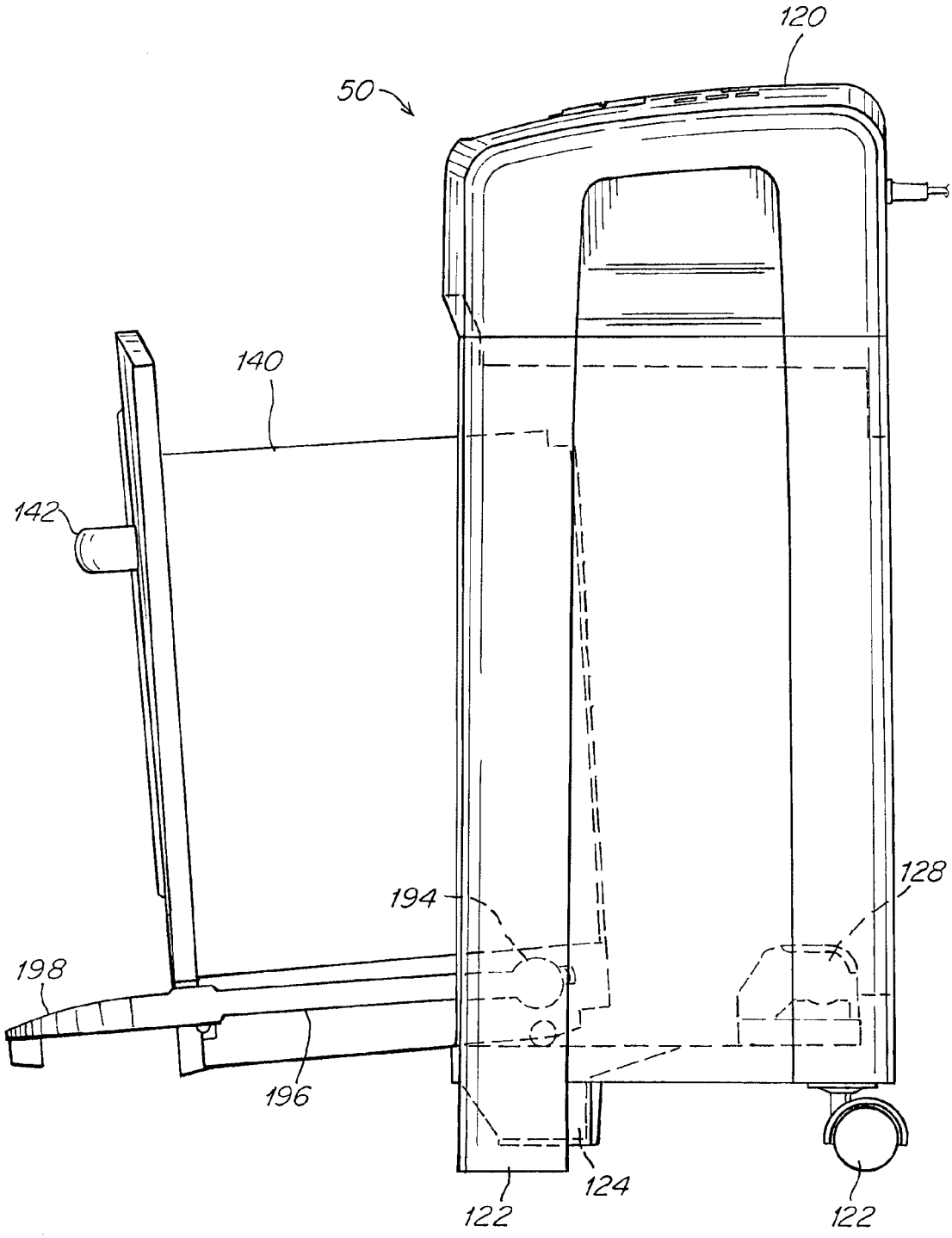
FIG. 10 illustrates a side view of the compacting shredder shown in FIG. 9.

Turning now to FIGS. 9-16, another embodiment of a compacting shredder 50 is shown. The shredder 50 includes a shredding mechanism 130 (see FIG. 15) which is at least partially enclosed within a housing 120. A receptacle 140 is positioned adjacent the housing 120 to contain material shredded by the shredder mechanism 30. As shown in FIG. 10, the receptacle 140 is removably coupled to the housing 120 and, in this particular embodiment, is configured as a drawer or basket slidably received within the housing 120. The receptacle 140 may have a handle 142 to facilitate the removal of the receptacle 140 from the housing 120 for emptying the shredded material 18 from the receptacle 140. The receptacle 140 may also include a window 144 to visually inspect the amount of accumulated shredded material 18 within the receptacle 140. Also, as illustrated in FIGS. 9 and 10, the housing 120 may extend down to form a ground contacting surface and may include a plurality of leg supports 122. In this embodiment, there are three leg supports 122 in the front of the shredder 50 and two leg supports 122 in the back of the shredder, where the back leg supports 122 include casters which may be used to move the shredder 50.

The shredder 50 has a foot-operated pedal or lever 198 coupled to the lower end of the receptacle 140 to actuate a compactor ram 170, which is discussed in greater detail below. In this particular embodiment, the foot-operated lever 198 is on the front side of the shredder 50 and includes arms 196 extending rearwardly on each side of the receptacle 140 (see FIGS. 10 and 11). At the distal end of each arm 196 is a receptacle cam 194. FIG. 12 is a detailed view of one of the receptacle cams 194 and illustrates the foot lever 198 and receptacle cam 194 in a non-actuated state with a fastener 190, such as a screw, coupling the receptacle cam 194 to the side of the receptacle 140. In one embodiment, the foot lever 198 pivots about an axis which may be defined by the axis of the fastener 190. In one embodiment, the receptacle cam 194 may includes a slot 192 to reduce the tension on the fastener 190 as the foot lever pivots down to an actuated state. As the foot lever 198 is depressed to actuate the compactor ram, the receptacle cam 194 and slot 192 may move up such that the stationary fastener 190 is then in a lower position within the slot 192.

Figure 11:
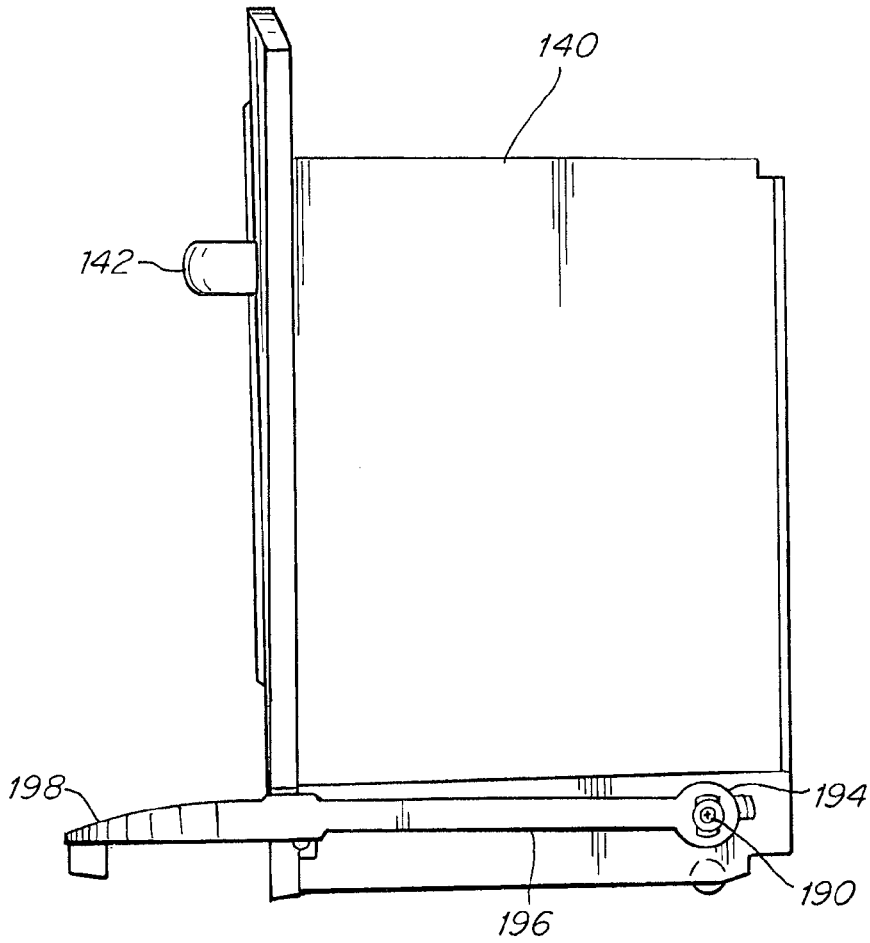
FIG. 11 illustrates a side view of a shredder receptacle according to one embodiment of the present invention.
Figure 12:
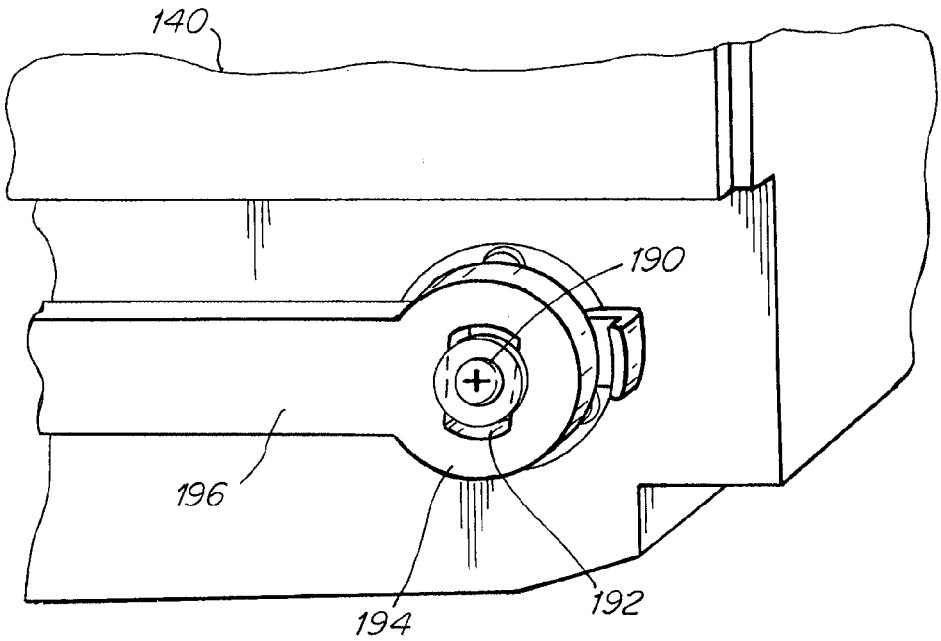
FIG. 12 is a detailed view of a portion of the shredder receptacle shown in FIG. 11.

It should be recognized that FIG. 11 shows the receptacle 140 separated from the housing 120 to better illustrate the arm 196 and the receptacle cam 194. In use, the receptacle 140 is coupled to the housing 120 so that the movement of the foot lever 198 actuates a compactor ram that may be coupled to the housing 120.

Figure 13:
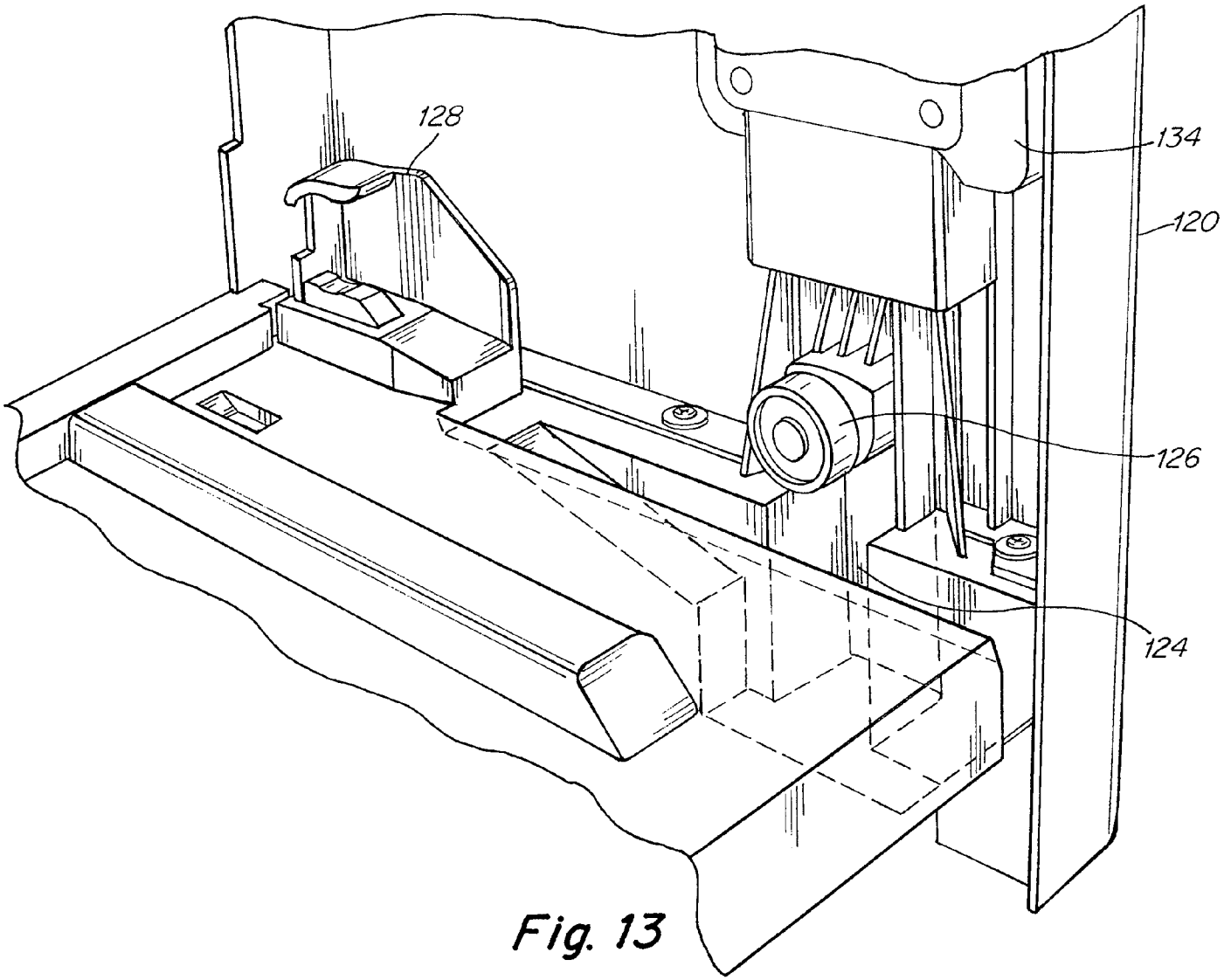
FIG. 13 is a detailed view of a portion of a shredder housing according to one embodiment of the present invention.

FIG. 13 illustrates the inside surface of the housing 120 that mates with the receptacle 140 according to one illustrative embodiment. In this particular embodiment, an inside cam well 128 retains the receptacle cam 194 when the receptacle 140 slides into the housing 120. An inside cam 126 is positioned in the housing 120 towards the front end of the shredder housing 120. The receptacle 140 is placed within the housing 120 such that the front end of the arm 196 rests on top of the inside cam 126 when the receptacle 140 is slid into the housing. Downward movement of the foot lever 198 then moves the inside cam 126 downwardly into the cam slot 124 shown in FIG. 13. It should be appreciated that in embodiments having an arm 196 and receptacle cam 194 on each side of the receptacle 140, a mating inside cam well 128 and inside cam 126 may also be positioned on each side of the shredder housing 120.

Figure 14:
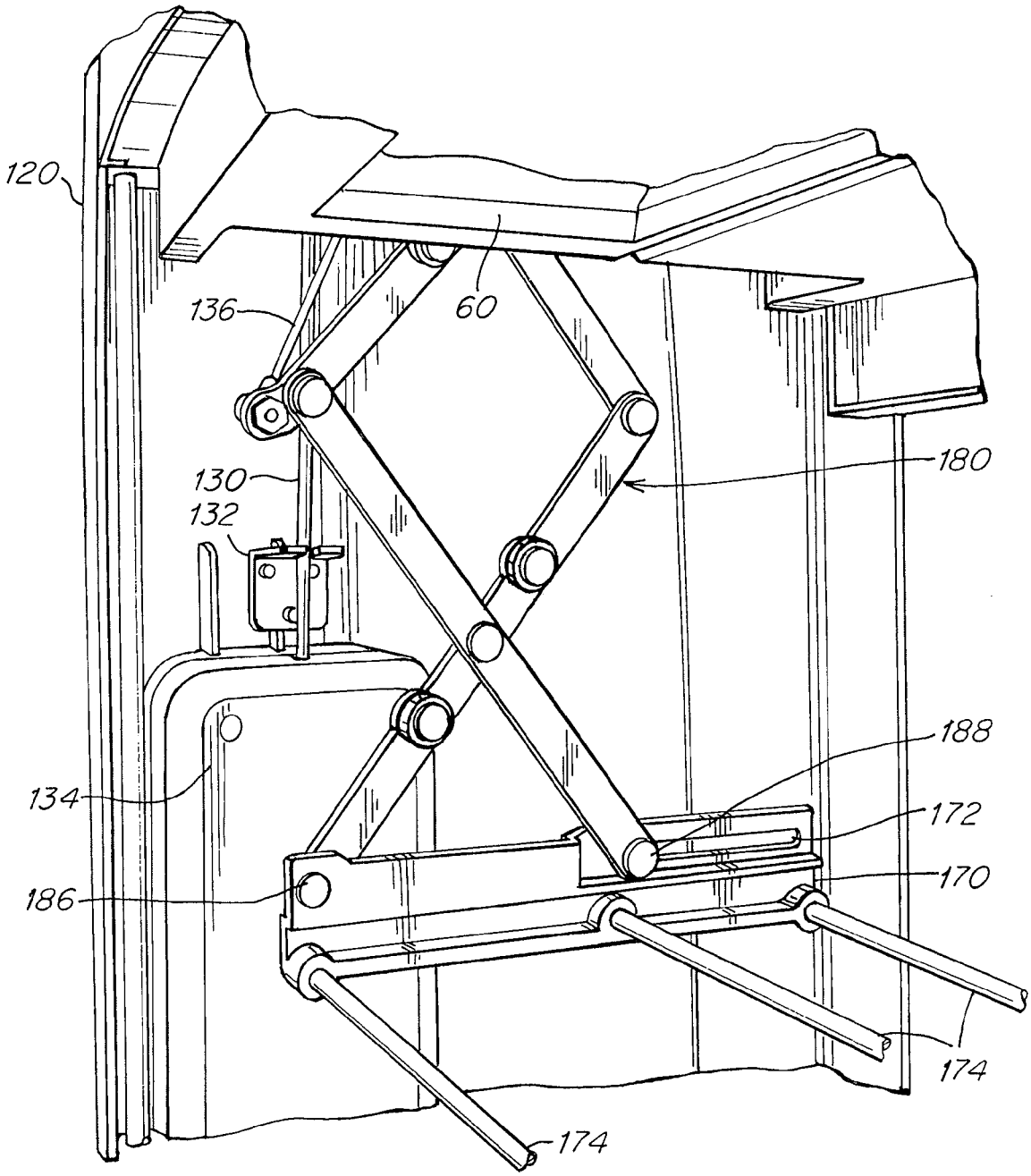
FIG. 14 is a detailed view of a compacting ram and scissor mechanism according to one embodiment of the present invention.
Figure 16:
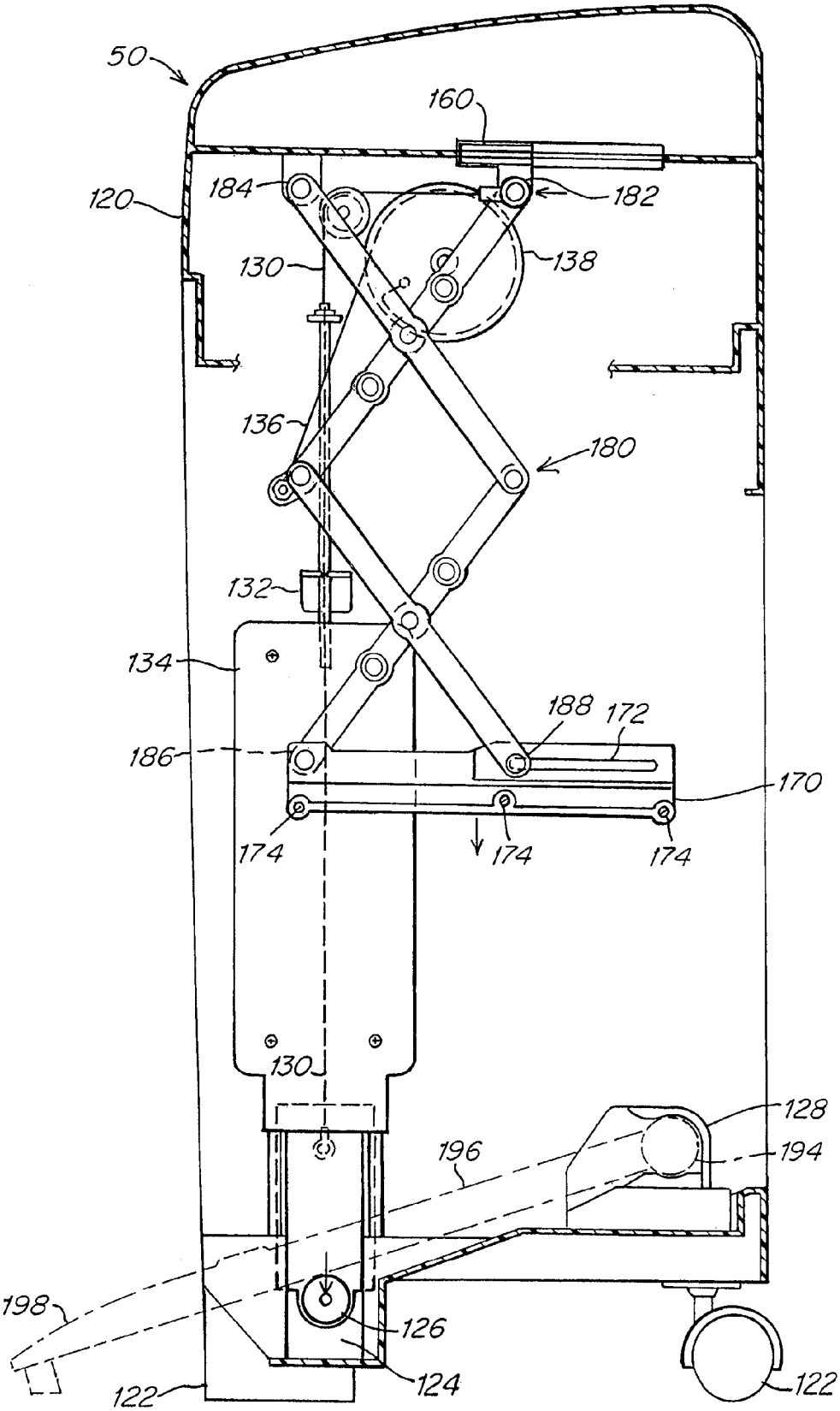
FIG. 16 is a schematic diagram of a shredder housing, scissor mechanism and compacting ram according to one embodiment of the present invention.

As the inside cam 126 moves downwardly into the slot 124, a cable 130 coupled to the inside cam 124 also moves down (see FIGS. 14 and 16). In one particular embodiment, the cable 130 extends in a substantially vertical direction along the front inside portion of the housing 120. One or more cable holders 132 may be provided to maintain the position of the cable 130 relative to the housing 120. In one embodiment, the cable holder 132 includes an L-bracket with a slot coupled to the inside wall of the housing 120. One or more covers 134 may also be provided to shield portions of the cable 130 from wear and tear as the receptacle 140 is slid in and out of the shredder housing 120.

As shown in the schematic drawing of FIG. 16, the cable 130 is coupled to a compacting ram 170 such that the as the cable 130 is pulled down by the inside cam 126, the compacting ram 170 is actuated. In the embodiment illustrated in FIGS. 14 and 16, the compacting ram 170 is mounted to a scissor-like mechanism 180 that guides the ram 170 downward to press the accumulated shredded material 18 toward the bottom of the receptacle 140. As shown, cable 130 is wrapped at least partially around wheel 150 and then extends out to an upper part of the scissor mechanism 180. In particular, the cable 130 is slidably coupled to the upper end 182 of the scissor mechanism 180 through slide 160 which may be coupled to an upper portion of the housing 120. In this particular embodiment shown in FIG. 16, downward movement of cable 130 due to movement of the inside cam 124 slides the upper end 182 of the scissor mechanism 180 to the left or to the front end of the shredder 50.

The scissor mechanism 180 also includes a fixed upper end 184 which, in this embodiment, is coupled to the front end of the shredder housing 120. As the upper end 182 of the scissor mechanism 180 moves toward the fixed upper end 184, the scissor mechanism 180 expands and moves downward such that the ram 170 can compact shredded material 18.

The lower end of the scissor mechanism 180 may also include one fixed end 186 and one slidably coupled end 188. In particular, the lower end of the scissor mechanism 180 includes one end 186 pivotally fixed to the compacting ram 170, and another lower end 188 of the scissor mechanism 180 slidably coupled to the compacting ram 170 through slot 172 (see FIG. 14). As the downward movement of the cable 130 moves the upper end 182 of the scissor mechanism 180 toward the fixed upper end 184, the lower slidably coupled end 188 of the scissor mechanism may also slide toward the lower fixed end 186 of the compacting ram 170 to move the compacting ram 170 downward to compact the shredded material 18 in the receptacle. It should be appreciated that for simplicity, the schematic diagram in FIG. 16 does not illustrate the receptacle 140.

Once the foot lever 198 is depressed and the compacting ram is activated 170, it may be desirable for both the compacting ram 170 and the foot lever 198 to automatically return to their non-activated states. In some embodiments, the compactor includes one or more resilient components to spring the compacting ram 170 and the foot lever back to their "up" or non-activated state once the foot lever 198 is not depressed by a user's foot. In one embodiment, a second cable 136 is coupled at one end to the scissor mechanism 180 and at the other end to a spring-loaded wheel 138. The wheel 138 may be biased to rotate in a clockwise direction. When the scissor mechanism 180 expands down due to the downward movement of the cable 130, the second cable 136 moves down with the scissor mechanism which rotates the spring-loaded wheel 138 in a counter-clockwise direction. When the user's foot is removed from the foot lever 198, the spring-loaded wheel 138 will rotate back in its biased clockwise direction pulling the second cable 136, scissor mechanism 180 and compacting ram 170 back to a non-activated state.

Figure 15:
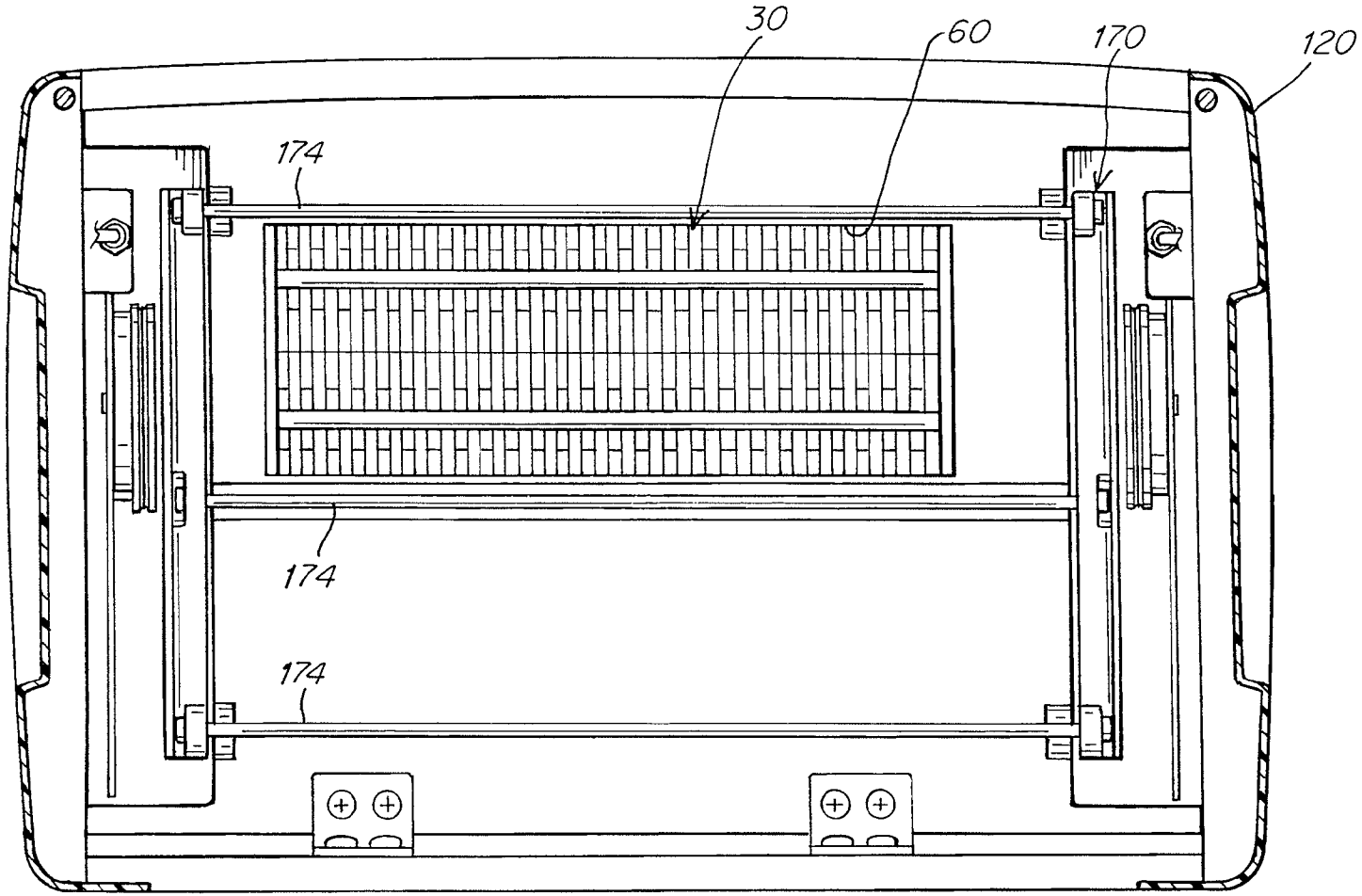
FIG. 15 is a cross-sectional bottom view of a portion of the shredder housing showing the shredding mechanism according to one embodiment of the present invention.

The compacting ram 170 according to one embodiment is shown in greater detail in FIGS. 14 and 15. In this particular embodiment, the compacting ram 170 includes a plurality of spaced apart bars 174 positioned adjacent to the shredder mechanism 30 prior to actuation. The spaced apart bars 174 compact shredded material 18 similar to the plate-like structure discussed above except the bar arrangement may prevent shredded material 18 from accumulating on the top of the compacting ram 170. In one embodiment, the compacting ram 170 includes three bars 174 spaced apart along the width of the housing 120. As shown in FIG. 15, in one embodiment, two of the bars 174 are spaced apart the approximate width of the outlet 60 below the shredding mechanism 30. In this respect, the bars 174 are arranged for the shredded material 18 to fall between these two bars and down to the bottom of the receptacle 140.

The various embodiments of compactors illustrated in FIGS. 2-16, when actuated, may reduce the volume of space in the receptacle that is available to shredded material by approximately 50%, although other reductions in volume are possible. By way of example, according to some embodiments, the volume is reduced by less than 50%, such as by less than 40% or less than 30%, as aspects of the invention are not limited in this respect. According to other embodiments, the volume is reduced by greater than 50%, such as by up to 60%, up to 70%, up to 80%, or even up to reductions in volume that near 95%, as aspects of the invention are not limited in this respect.

Turning now to FIGS. 17-22, embodiments of the present invention directed to a shredder that occupies less space while still being capable of shredding documents of a size commonly found in an office, and/or shredders that are less prone to jamming will now be discussed in greater detail below.

Figure 17A:
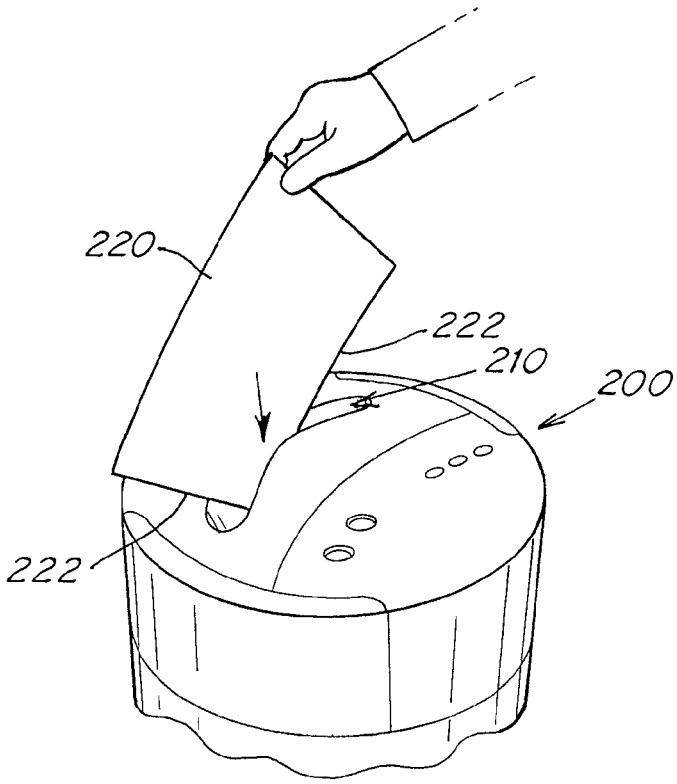
FIGS. 17*a*-17*c* illustrate paper being fed to a paper shredder that includes an inlet that folds edges of the paper, according to one embodiment.
Figure 17B:
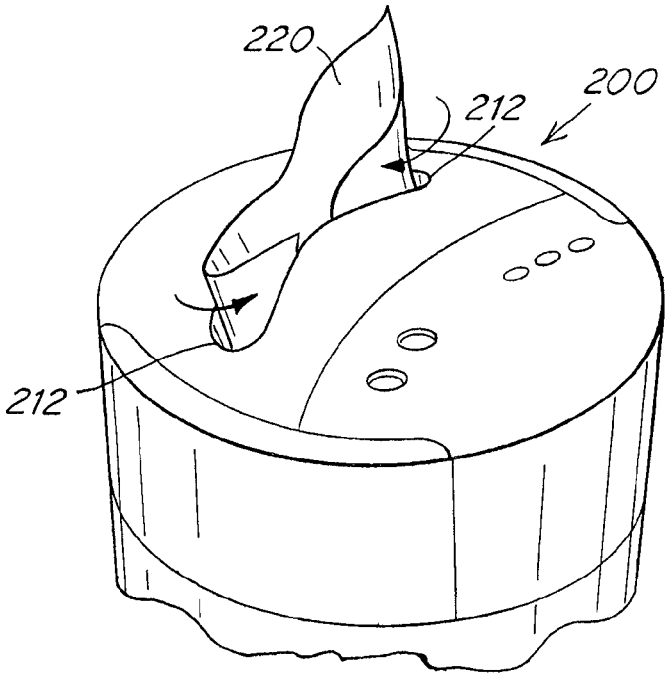
Figure 17C:
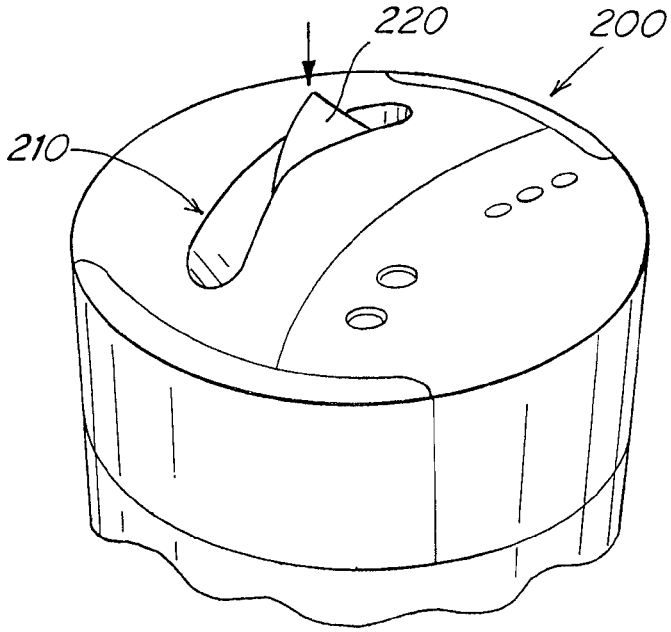

FIGS. 17*a*-17*c* illustrate an embodiment of a paper shredder 200, according to the present invention, that has a paper inlet 210 configured to automatically fold edges of the paper 220 before shredding. Paper 220 may be fed at an angle, or even corner first to the shredder 200 such that two leading edges 222 of the paper 220 are initially received in the paper inlet 210. As represented by FIG. 17*b*, contact between sides 212 of the inlet 210 and the leading edges 222 of the paper 220 can cause the edges 222 to be folded or curved back toward a central portion 214 of the paper inlet 210. Folding the paper 220 in this manner reduces the effective width of the paper 220 that is passed to the shredding mechanism, and may also reduce the likelihood of paper jams from occurring.

Figure 18:
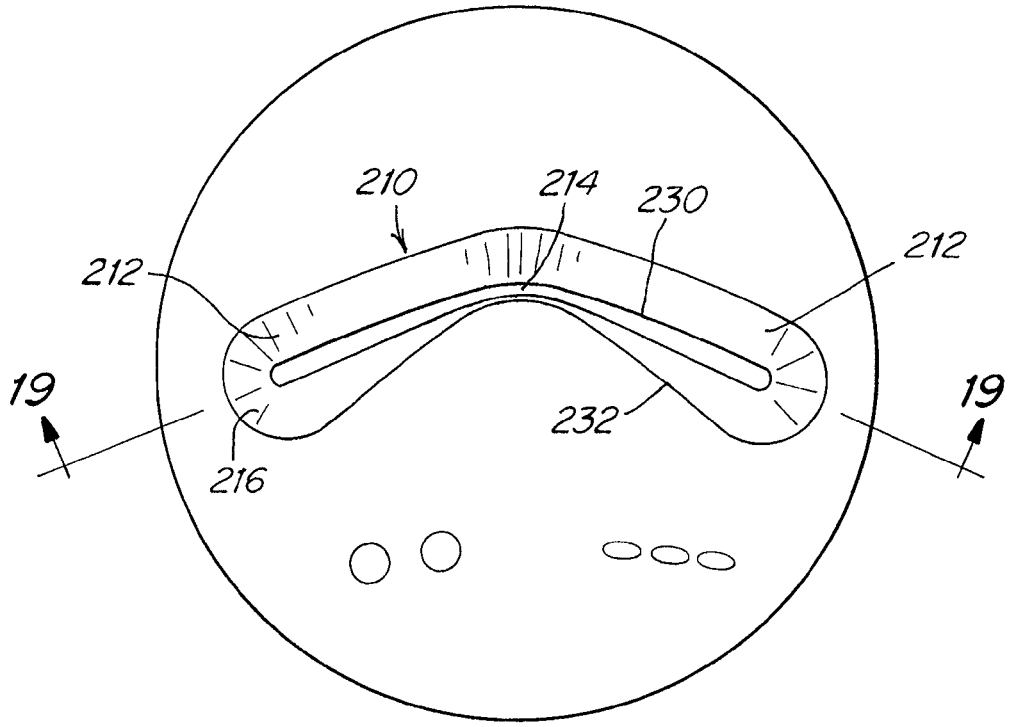
FIG. 18 is a top view of the paper inlet embodiment illustrated in FIGS. 17*a*-17*c;*

Several features that may promote the folding of paper 220 that is fed to a paper inlet 210 are shown in FIG. 18, which is a top view of the paper inlet 210 shown in FIGS. 17*a*-17*c*.

The sides 212 of the paper inlet 210 may be shaped to promote folding of paper 220 that contacts the paper inlet sides 212. In the embodiment of FIG. 18, this is accomplished with sides 212 that have rounded surfaces 216 positioned to direct leading edges 222 of the paper, once received, back toward a central portion 214 of the inlet, thus folding the edge 222 of the paper. The rounded surfaces 216 receive and allow a leading edge 222 of the paper 220 to slide along the rounded surface. The leading edge 222 and following portions of the paper 220 continue to follow along the rounded surface 216 and, if necessary, extend back toward a central portion 214 of the inlet. In one embodiment, the sides 212 of the inlet 210, have a radius of between about 1 inch and about ⅛ inch, about which the leading edges 222 are guided. It is to be appreciated, however, that the sides 212 of the inlet 210 may have other radiuses, may have varying radiuses, and/or may even lack rounded surfaces 216 altogether, as aspects of the invention are not limited in this respect.

The paper inlet 210 may be constructed to promote smooth sliding of paper 220 against the paper inlet sides 212. According to some embodiments, this is accomplished by forming the inlet sides of smooth, injection molded plastic, although the sides may also be formed of different materials through different manufacturing processes. In other embodiments, the paper inlet is formed of cast metal, stamped and formed metal, or other materials, as aspects of the invention are not limited in this respect.

The paper inlet 210 may comprise an overall shape that promotes the folding of paper 220 that is fed through the inlet. As shown in FIG. 18, the paper inlet 210 may have an overall shape that curves generally about an axis that lies parallel to the direction in which paper is fed to the shredder. The curved shape of the paper inlet 210 may direct leading edges 222 of the paper 220 toward the rounded surfaces 216 of the inlet sides 212, where the leading edges are guided along the rounded surface 216 and back toward a central portion 214 of the inlet, as described above.

Figure 19:
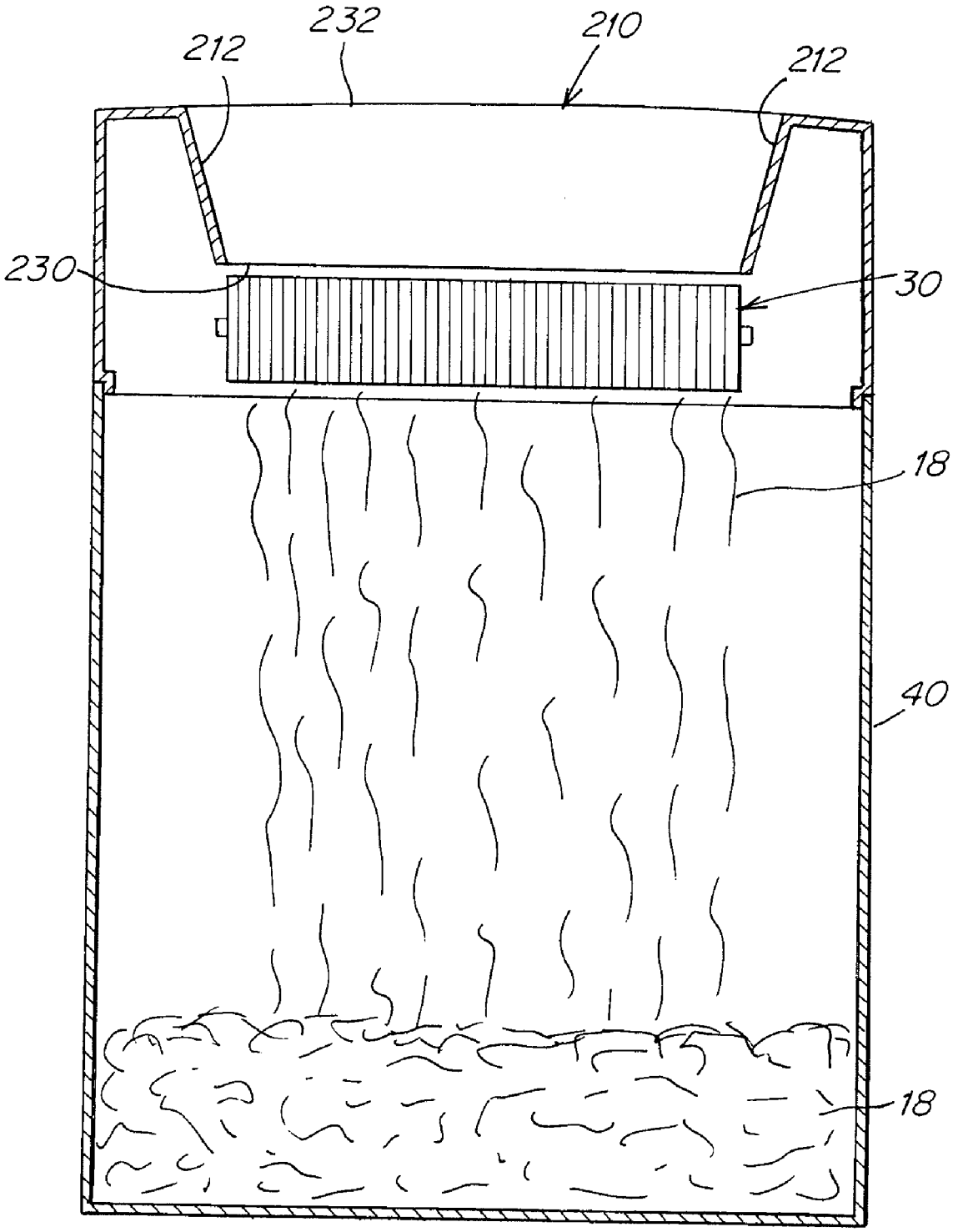
FIG. 19 is a cross-sectional view of the paper inlet embodiment shown in FIG. 18 taken along lines 19-19 of FIG. 18.

Each portion of the paper inlet 210 shown in FIGS. 18 and 19 tapers to a reduced width at points closer to the shredding mechanism 30, which may promote folding of paper 220 that passes through the inlet 210. The wider mouth 232 of the inlet 210 allows more room for the paper edges to move through a folding motion. The narrower outlet 230 of the paper inlet helps create a more compact fold prior to the paper being fed to the shredding mechanism 30. In the illustrated embodiment, the sides 212 are tapered at an angle of roughly 15 degrees, although greater angles, such as 20 degrees or greater, 25 degrees or greater, or even 30 degrees or greater are possible. It is also to be appreciated that smaller angles, including sides 212 that lack a taper altogether, are also possible, and that according to some embodiments, only one side of a paper inlet 210 may include a taper.

The lower edge 230 of a tapered paper inlet (which may also be considered the outlet) may have a width that corresponds to a width of the shredding mechanism 30, as shown in the cross-sectional view of FIG. 19. In this respect, the opposed cutters of the shredding mechanism 30 may have a width that is smaller than might otherwise be necessary. A reduction in the width of the cutters may reduce the cost to manufacture the paper shredder and/or may reduce the overall size of the paper shredder.

Figure 20:
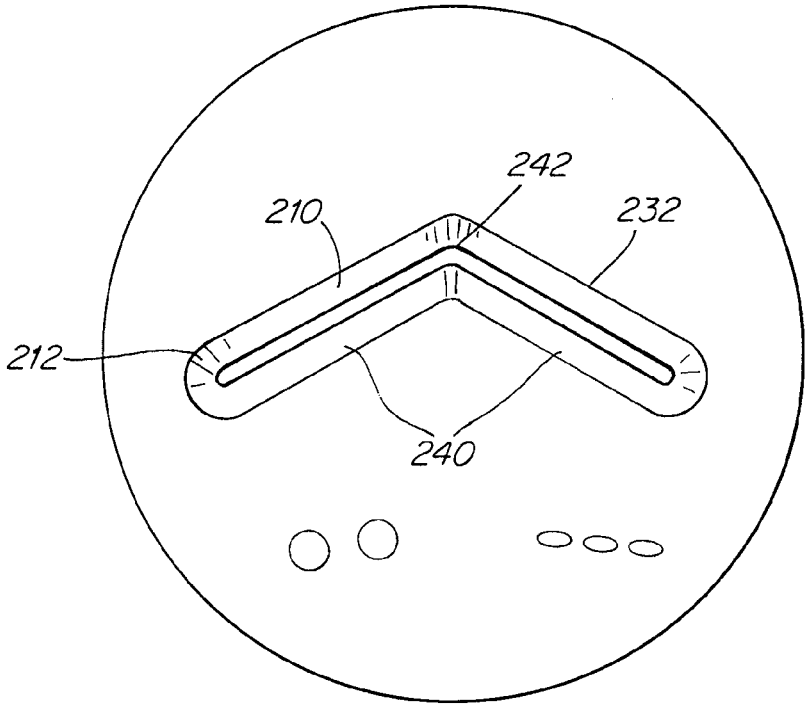
FIG. 20 illustrates an embodiment of a paper shredder that includes a 'V' shaped paper inlet.

According to some embodiments, as represented by FIG. 20, the curved inlet 210 may comprise more of a 'V' shape or beveled shape that includes a pair of substantially straight legs 240 connected to one another at a common apex 242. Still, other configurations of curved inlets are possible, as aspects of the present invention are not limited in this respect.

The radius of curvature of the curved inlet 210 and/or the angle of curvature at the apex 242 of a inlet that has a 'V' shaped curve may affect the consistency with which paper 220 is folded by the paper inlet 210 and may affect whether, or to what extent, paper is crinkled when passed through the inlet. The degree of curvature/angle of the apex 242 may be optimized, through experimentation, such that consistent paper folding is obtained by the paper inlet and excessive crinkling is avoided. According to some embodiments, with a 6-inch wide paper inlet, the radius of curvature lies between about 2 inches and about 9 inches at various places, although other radiuses are possible.

Embodiments of the paper inlet 210 can be configured such that the thickness of the paper or stack of papers that are passed through the paper inlet is increased by a factor of two. In some of such embodiments, the inlet 210 is configured to prevent the thickness of the paper or stack of papers from increasing by any more than a factor of two. Configuring the paper inlet 210 in this manner may help control the maximum thickness of paper that is passed to the cutters of the shredding mechanism 30, which may prevent paper jams from occurring.

Figure 21A:
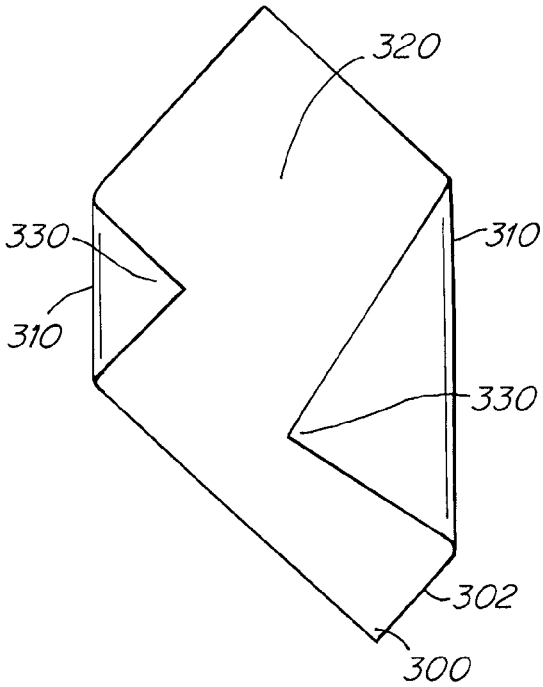
FIGS. 21*a*-21*b* illustrate paper that has been folded in a manner to prevent doubling of the paper thickness.

In some embodiments, the paper inlet 210 is configured to fold edges of paper toward a central portion 214 of the paper inlet 210, and no further, as represented by FIG. 21*a*. As shown in FIG. 21*a*, the leading corner 300 and leading edge 302 of the paper may be fed into the paper inlet. The paper inlet may be configured to create folds 310 on the trailing corners 330 of the paper. In this illustrative embodiment, both trailing corners 330 are folded into the central portion 320 of the paper. To accomplish this, the paper inlet may be configured with a width, taken along the curvature of the paper inlet, that is no greater than twice the maximum width of paper that is to be received by the shredder. By way of example, 8½"× 11" paper has a maximum width, taken from corner to corner, of approximately 6.95". The width of the paper inlet may be set to correspond to half of the maximum width of the paper to prevent the thickness of paper from being more than doubled as the paper passed through the paper inlet.

Figure 21B:
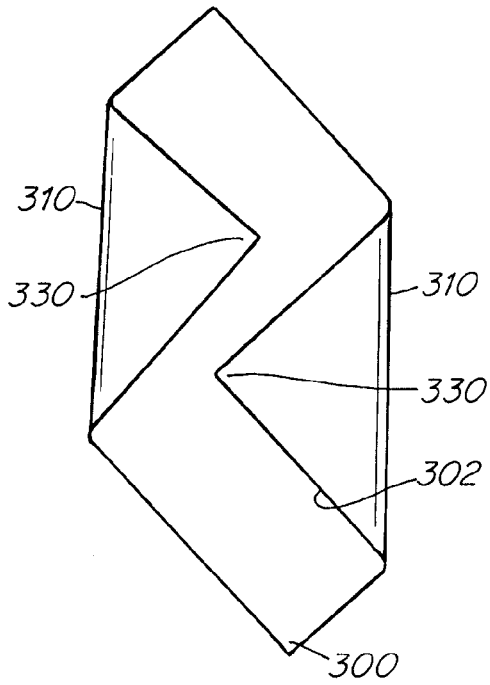

According to some embodiments, the paper inlet may have a width that is less than half of the maximum width of paper that is to be shredded. In such embodiments, paper or stacks of paper may be folded, as shown in FIG. 21*b*, while still preventing the thickness of the paper or stack of papers from increasing by more than a factor of two. This may be accomplished by allowing each trailing corner 330 of the paper or stack of papers to be folded beyond the central portion 320 of the paper inlet, while preventing each trailing corner 330 from being folded over the opposed trailing corner, or otherwise tripling the thickness of the paper or stack of papers.

Embodiments of the paper shredder may be configured to accommodate paper of different sizes. According to one embodiment, the paper shredder has a paper inlet that is about 6 inches wide and that can accommodate up to ten sheets of 8½"×11" paper that is fed, corner first, to the inlet. According to another embodiment, the inlet is about 9" wide and can accommodate up to ten sheets of 11"×17" that is fed, corner first, to the inlet. It is to be appreciated that these are but a few examples of inlet sizes, and that others are possible, as aspects of the present invention are not limited in this respect.

Figure 22A:
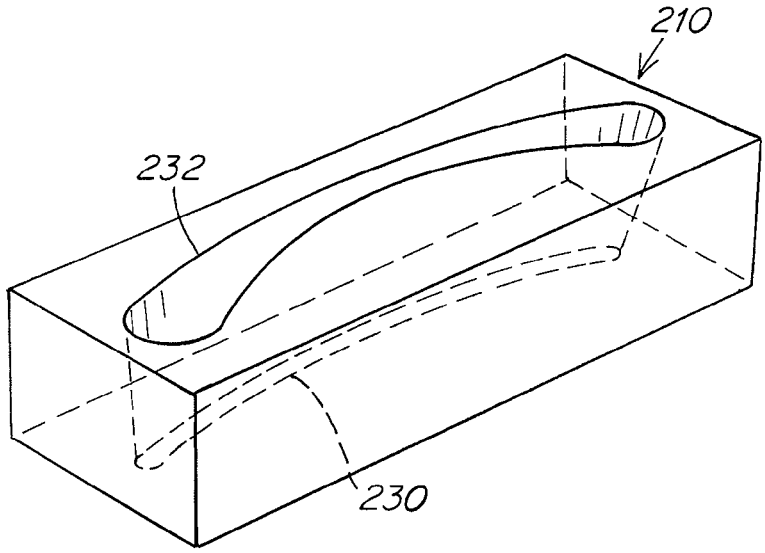
FIGS. 22*a*-22*c* illustrate a paper inlet, according to one embodiment.
Figure 22B:
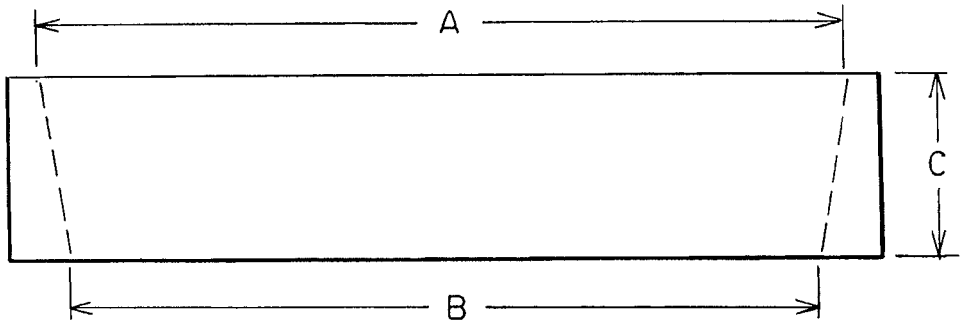
Figure 22C:
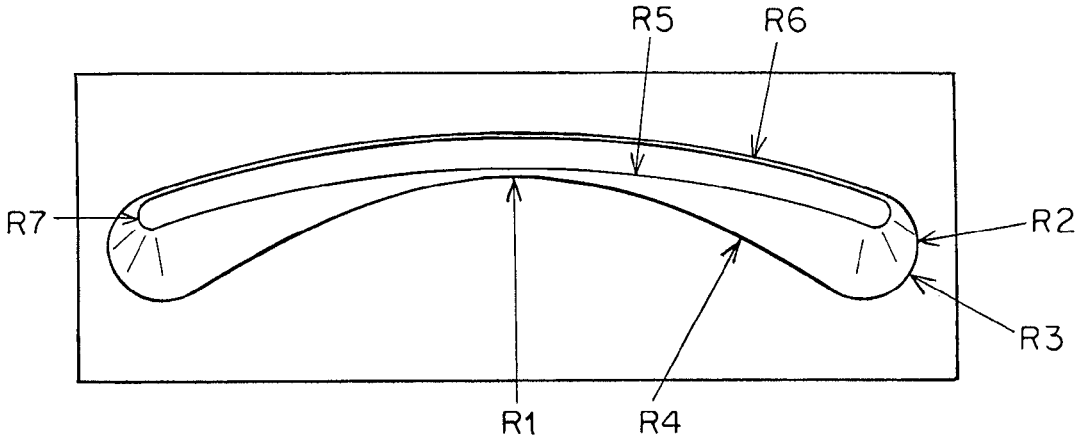

FIGS. 22*a*-22*c* illustrate one particular inlet 210 configuration. In this particular embodiment, the width "A" of the mouth 232 of the inlet is approximately 6.43 inches, the width "B" at the outlet 230 tapers down to approximately 6 inches, and the height of the paper inlet 210 is approximately 1.5 inches. As mentioned above, the radius of curvatures of both the mouth 232 and outlet 230 of the paper inlet 210 may vary as the invention is not so limited. However, in one particular embodiment shown in FIG. 22*c*, the mouth 232 has the following radius of curvatures: R1=2 inches, R2=0.43 inches, R3=0.43 inches and R4=4.59 inches, and the outlet 230 has the following radius of curvatures: R5=8.79 inches, R6=9.04 inches and R7=0.125 inches.

Embodiments of the paper inlet described herein may be incorporated into a variety of types of shredders. By way of example, embodiments of the paper inlet may be included in shredders configured to shred flexible items other than paper. Embodiments of the paper inlet may be positioned on various surfaces of a shredder, such as on a substantially flat upper surface of a shredder or on a substantially slanted or beveled upper surface of a shredder.

It should be appreciated that various embodiments of the present invention may be formed with one or more of the above-described features. The above aspects and features of the invention may be employed in any suitable combination as the present invention is not limited in this respect. It should also be appreciated that the drawings illustrate various components and features which may be incorporated into various embodiments of the present invention. For simplification, some of the drawings may illustrate more than one optional feature or component. However, the present invention is not limited to the specific embodiments disclosed in the drawings. It should be recognized that the present invention encompasses embodiments which may include only a portion of the components illustrated in any one drawing figure, and/or may also encompass embodiments combining components illustrated in multiple different drawing figures.

It should be understood that the foregoing description of various embodiments of the invention are intended merely to be illustrative thereof and that other embodiments, modifications, and equivalents of the invention are within the scope of the invention recited in the claims appended hereto.

What is claimed is:

1. A shredder comprising:

a shredding mechanism;

a housing at least partially enclosing the shredding mechanism;

a receptacle, to which the housing is removably coupled, that receives and contains shredded material;

a compactor comprising a ram that, when actuated, moves through the receptacle to compress shredded material in the receptacle; wherein a center portion of the ram includes only a plurality of spaced apart bars positioned adjacent to the shredder mechanism prior to actuation.

2. The shredder according to claim 1, wherein the compactor comprises a scissor mechanism that guides the ram through the receptacle.

3. The shredder according to claim 1, wherein the compactor is coupled to the housing.

4. The shredder according to claim 1, further comprising a spring-loaded cable constructed and arranged to return the compacting ram to a non-activated state.

5. The shredder according to claim 1, wherein the compactor comprises a hand operated lever to actuate the ram.

6. The shredder according to claim 1, further comprising a foot operated lever coupled to the compactor to actuate the ram.

7. The shredder according to claim 6, wherein the foot operated lever is depressed to actuate the compactor ram.

* * * * *